US011450940B2

(12) United States Patent
Clifford et al.

(10) Patent No.: US 11,450,940 B2
(45) Date of Patent: Sep. 20, 2022

(54) MECHANICAL ACTUATORS FOR A WIRELESS TELECOMMUNICATION ANTENNA MOUNT

(71) Applicant: Radiarc Technologies, LLC, Wakefield, MA (US)

(72) Inventors: Arthur P. Clifford, Gloucester, MA (US); Stephen J. Holmes, Revere, MA (US)

(73) Assignee: Radiarc Technologies, LLC, Wakefield, MA (US)

( * ) Notice: Subject to any disclaimer, the term of this patent is extended or adjusted under 35 U.S.C. 154(b) by 0 days.

(21) Appl. No.: 17/315,232

(22) Filed: May 7, 2021

(65) Prior Publication Data

US 2021/0328342 A1 Oct. 21, 2021

Related U.S. Application Data

(63) Continuation-in-part of application No. 17/183,151, filed on Feb. 23, 2021, which is a continuation of (Continued)

(51) Int. Cl.
*H01Q 1/12* (2006.01)
*H01Q 1/24* (2006.01)

(52) U.S. Cl.
CPC ..... *H01Q 1/1228* (2013.01); *H01Q 1/125* (2013.01); *H01Q 1/246* (2013.01)

(58) Field of Classification Search
CPC ..... H01Q 3/005; H01Q 3/02; H01Q 3/04; H01Q 3/06; H01Q 3/08; H01Q 1/1228; H01Q 1/246; H04W 16/28
See application file for complete search history.

(56) References Cited

U.S. PATENT DOCUMENTS 9,306,278 B2 4/2016 Lever et al.
10,511,090 B2 12/2019 Clifford et al.
(Continued)

FOREIGN PATENT DOCUMENTS

CN 1937803 A 3/2007
EP 2424040 A1 2/2012
(Continued)

OTHER PUBLICATIONS

Gemintek—RET Solution Expert, "Precisian AISG Device Manager", Gemintek Corporation, 5F-1, No. 8, Alley 30, Lane 358, Ruiguang Road, Neihu, Taipei, Taiwan, http:www.gemintek.com.tw.

*Primary Examiner* — Daniel Munoz
(74) *Attorney, Agent, or Firm* — Barlow, Josephs & Holmes

(57) ABSTRACT

A remotely controllable antenna mount for use with a wireless telecommunication antenna provides both mechanical azimuth and mechanical tilt adjustment using AISG compatible motor control units and AISG control and monitoring systems to remotely adjust the physical orientation of the antenna. The mount control units are serially interconnected with existing AISG antenna control units (ACU's) which adjust internal electronic tilt of the antenna. The present solution provides the ability to both physically aim the antenna to adjust coverage area and also adjust the signal phase to fine tune the quality of the signal.

9 Claims, 23 Drawing Sheets

Related U.S. Application Data application No. 16/315,229, filed as application No. PCT/US2017/041586 on Jul. 11, 2017, now Pat. No. 10,944,169, which is a continuation-in-part of application No. 15/207,159, filed on Jul. 11, 2016, now Pat. No. 10,511,090.

(60) Provisional application No. 63/157,859, filed on Mar. 8, 2021, provisional application No. 63/021,881, filed on May 8, 2020, provisional application No. 62/383,647, filed on Sep. 6, 2016.

(56) References Cited

U.S. PATENT DOCUMENTS

2003/0160731 A1 8/2003 Wensink
2007/0241979 A1 10/2007 Yang
2007/0290935 A1 12/2007 Franzon et al.
2008/0036670 A1* 2/2008 Arvidsson ..... H01Q 3/32 343/758
2009/0135074 A1 5/2009 Yang et al.
2010/0231450 A1 9/2010 Le Sage
2012/0062356 A1* 3/2012 Mann ..... H01Q 1/246 340/3.5
2015/0144758 A1* 5/2015 Kolokotronis ..... H01Q 1/1228 248/282.1
2016/0240910 A1* 8/2016 Balter ..... G01S 3/46
2017/0040682 A1* 2/2017 Lee ..... H04B 17/17
2017/0289323 A1 10/2017 Gelvin et al.
2019/0372686 A1 12/2019 Patel

FOREIGN PATENT DOCUMENTS

WO 2011140794 A1 11/2011
WO 2018013602 A2 1/2018

* cited by examiner

MECHANICAL ACTUATORS FOR A WIRELESS TELECOMMUNICATION ANTENNA MOUNT

CROSS-REFERENCE TO RELATED APPLICATIONS

This application is a continuation-in-part of U.S. application Ser. No. 17/183,151, filed Feb. 23, 2021, which is a continuation of U.S. application Ser. No. 16/315,229, filed Jan. 4, 2019, now U.S. patent Ser. No. 10/944,169, issued Mar. 9, 2021, which is a Section 371 national stage filing of PCT/US2017/041586 filed Jul. 11, 2017, which is a continuation-in-part of U.S. application Ser. No. 15/207,159, filed Jul. 11, 2016, now U.S. patent Ser. No. 10/511,090, issued Dec. 17, 2019. PCT/US2017/041586 also claims the benefit of U.S. Provisional Application No. 62/383,647 filed Sep. 6, 2016, the entire contents of which is incorporated herein by reference.

The application also claims the benefit of U.S. Provisional Patent Application Nos. 63/021,881, filed May 8, 2020 and 63/157,859, filed Mar. 8, 2021, the entire contents of which are each incorporated herein by reference in their entirety.

BACKGROUND OF THE INVENTION

Field of the Invention

The instant invention relates to wireless telecommunication (T/C) systems. More specifically, the invention relates to a wireless T/C antenna mounts and their methods of operation.

Description of Related Art

Over the last 20 years, the use of cellular phones as a primary means of communication has exploded worldwide. In order to provide coverage area and bandwidth for the millions of cell phones in use, there has also been a huge increase in the number of T/C transmitter/receiver antenna installations (T/C installations) and the number of T/C transmitter/receiver antennas (antennas) mounted on those T/C installations. In most cases, the antennas are mounted on towers, monopoles, smokestacks, buildings, poles or other high structures to provide good signal propagation and coverage. There are literally hundreds of thousands of T/C installations in the U.S., with each installation carrying multiple antennas from multiple carriers.

Referring to FIGS. 1-3, each tower or installation 10 has an associated base station 12, which includes power supplies, radio equipment, interfaces with conventional wire and/or fiber optic T/C system nodes 14, microwave links, etc. The base station node(s) 14, in turn, have a wireless or wired connection to each carrier's Network Operations Center (NOC) 16 to monitor and control the transmission of T/C signals to and from the antennas 18 and over the carrier's network.

At each tower installation, each carrier will typically have three separate antennas 18 oriented 120° apart to serve three operational sectors of its service area. Some installations may also have multiple different antennas in each sector transmitting and receiving separate communication bandwidths. However, it should be noted that many other types of installations may have only a single antenna 18. For example, antennas 18 mounted on the sides of building are typically pointed in a single direction to provide coverage in a particular direction, i.e. towards a highway.

Each antenna 18 is typically mounted on a vertical pole 20 using a mount 22 having some ability to manually adjust the orientation (azimuth and tilt) of the antenna 18 relative to the desired service area. Typical manual adjustment of tilt, or downtilt position (angular direction around a horizontal pivot axis) involves manually tilting the antenna 18 downward using a mechanical downtilt bracket 21 (usually provided as part of the mount or antenna) and rigidly clamping or tightening the tilt bracket 21 in the desired position (FIGS. 2A and 2B). Typical manual adjustment of an azimuth position (angular direction around a vertical axis) involves manually rotating the mount 21 around the vertical pole 20 and physically clamping the mount 21 in the desired position (FIGS. 2C and 2D). The fixed mounting positions are not typically moved unless absolutely necessary.

When a carrier designs a service coverage area, they will specify the desired azimuth and tilt angles of the antennas 18 that they believe will provide the best service coverage area for that installation 10. Antenna installers will climb the tower or building and install the antennas 18 to the provider's specifications and orientation (azimuth and mechanical tilt). Operational testing is completed and the antenna mounts 21 are physically clamped down into final fixed positions. However, various environmental factors often affect the operation of the antennas 18, and adjustments are often necessary. RF interference, construction of new buildings in the area, tree growth, etc. are all issues that affect the operation of an antenna 18. Additionally, the growth of surrounding population areas often increases or shifts signal traffic within a service area requiring adjustments to the RF service design for a particular installation. Further adjustment of the antennas 18 involves sending a maintenance team back to the site to again climb the tower or building and manually adjust the physical orientation of the antenna(s) 18. As can be appreciated, climbing towers and buildings is a dangerous job and creates a tremendous expense for the carriers to make repeated adjustments to coverage area as well as a tremendous risk for the tower climbers.

As a partial solution to adjusting the vertical downtilt of an antenna 18, antennas may include an internal "electrical" tilt adjustment which electrically shifts the signal phase of internal elements (not shown) of the antenna 18 to thereby adjust the tilt angle of the signal lobe (and in some cases reduce sidelobe overlap with other antennas) without manually adjusting the physical azimuth or tilt of the antenna 18. This internal tilt adjustment is accomplished by mounting internal antenna elements on a movable backplane and adjusting the backplane with an antenna control unit (ACU) 24 which integrated and controlled through a standard antenna interface protocol known as AISG (Antenna Interface Standards Group). Referring to FIG. 3, the antennas 18 are connected to the local node through amplifiers 26 (TMA—tower mounted amplifiers). A local CNI (control network interface) 28 controls the TMAs 26 and ACUs 24 by mixing the AISG control signal with the RF signal through bias T connectors 30. Each carrier uses the AISG protocols to monitor and control various components within the T/C system from antenna to ground. Antenna maintenance crews can control the electrical tilt of the antennas 18 from the local CNI 28 at the base station 12 and, more importantly, the carrier NOC 16 has the ability to see the various components in the signal path (antenna line devices or ALD's) and to monitor and control operation through the AISG protocols and software.

While this limited phase shift control (electrical downtilt) is somewhat effective at adjusting the coverage area, it is not a complete solution since adjustment of the signal phase of the internal antenna elements often comes at the expense of signal strength and interference of the backward facing transmission lobe with other tower structure and components. In other words, shifting the signal phase provides the limited ability to point, steer or change the coverage area without physically moving the antenna 18, but at the same time significantly degrades the strength of the signal being transmitted or received. Reduced signal strength means dropped calls and reduced bandwidth (poor service coverage). This major drawback is no longer acceptable in T/C systems that are being pushed to their limits by more and more devices and more and more bandwidth requirements.

SUMMARY OF THE INVENTION

Cellular carriers and RF designers have become overly reliant on the internal signal phase adjustments to adjust coverage area to the extent that they are seriously degrading signal quality at the expense of a perceived increase in coverage area or perceived reduction in interference.

A remotely controllable antenna mount for use with a wireless telecommunication antenna provides both mechanical azimuth and mechanical tilt adjustment using AISG compatible motor control units and AISG control and monitoring systems to remotely adjust the physical orientation of the antenna. The mount control units are serially interconnected with existing AISG antenna control units (ACU's) which adjust internal electronic tilt of the antenna. The present solution provides the ability to both physically aim the antenna to adjust coverage area and also adjust the signal phase to fine tune the quality of the signal.

An exemplary embodiment of the present antenna mount includes a structure side interface and an antenna side interface which are rotatable relative to each other through upper and lower pivots aligned along a vertical axis. The pivots provide rotatable movement about the vertical axis through a range of azimuth angle positions. An AISG compatible mount azimuth control unit (MACU) has a motor mounted on the structure side interface to drive rotatable movement of the antenna through a range of azimuth angle positions. The exemplary embodiment of the antenna mount further includes a mechanical downtilt assembly mechanically interconnected between the antenna interface and the antenna. The mechanical downtilt assembly includes a lower hinge connector connected between a lower portion of the antenna interface and a lower portion of the antenna where the lower hinge connector is pivotable about a horizontal axis. The mechanical downtilt assembly further includes a linear actuator drive connected between an upper portion of the antenna interface and an upper portion of the antenna where the linear actuator is linearly extendable to pivot the antenna about the lower hinge connector through a range of tilt angle positions.

The antenna interface includes an antenna mounting mast rotatably connected to the structure side interface. The antenna is mounted to the linear mast and rotation of the mast is driven by the azimuth control unit.

Operational methods of the control system include selectively controlling either or both of the MACU and the MTCU in conjunction with the ACU to both physically orient the antenna and to adjust the electrical downtilt through a common interface.

Accordingly, there is provided a unique and novel antenna mount and control configuration which is highly desirable for easy adjustment of antenna coverage, which reduces costs of tower visits, and which reduces the liability of tower climbing crews for manual adjustment of antenna orientation.

BRIEF DESCRIPTION OF THE DRAWINGS

While the specification concludes with claims particularly pointing out and distinctly claiming particular embodiments of the instant invention, various embodiments of the invention can be more readily understood and appreciated from the following descriptions of various embodiments of the invention when read in conjunction with the accompanying drawings in which:

DETAILED DESCRIPTION OF THE INVENTION

Generally, a remotely controllable antenna mount as indicated at 600/700/800/1000 in the various figures is particularly useful with a wireless telecommunication antenna 102 to provide mechanical azimuth and/or mechanical tilt adjustment using AISG compatible motor control units and AISG control and monitoring systems to remotely adjust the physical orientation of the antenna 102.

Antenna 102 may comprise any commercially available telecommunication antenna from any carrier, operating over any communication bandwidth. The antenna generally comprises a housing 102A and rearwardly facing upper and lower connection brackets 102B, which have a horizontal hinge connection 102C. The antenna connection brackets 102B generally have a standard spacing, but there is significant variation from each manufacturer depending on the antenna size and configuration. For ease of description, an exemplary antenna 102 may comprise a single band antenna and may have a single Antenna Control Unit (ACU) 104 controllable from the local base station 12 and/or carrier NOC 16.

As will be described further hereinbelow, the mount AISG control units are serially interconnected with AISG antenna control units (ACU's) 104 which adjust internal electronic tilt of the antenna 102. The present invention therefore provides the ability to both physically aim the antenna to adjust coverage area and also internally adjust the signal phase to fine tune the quality of the signal.

Figure 4A:
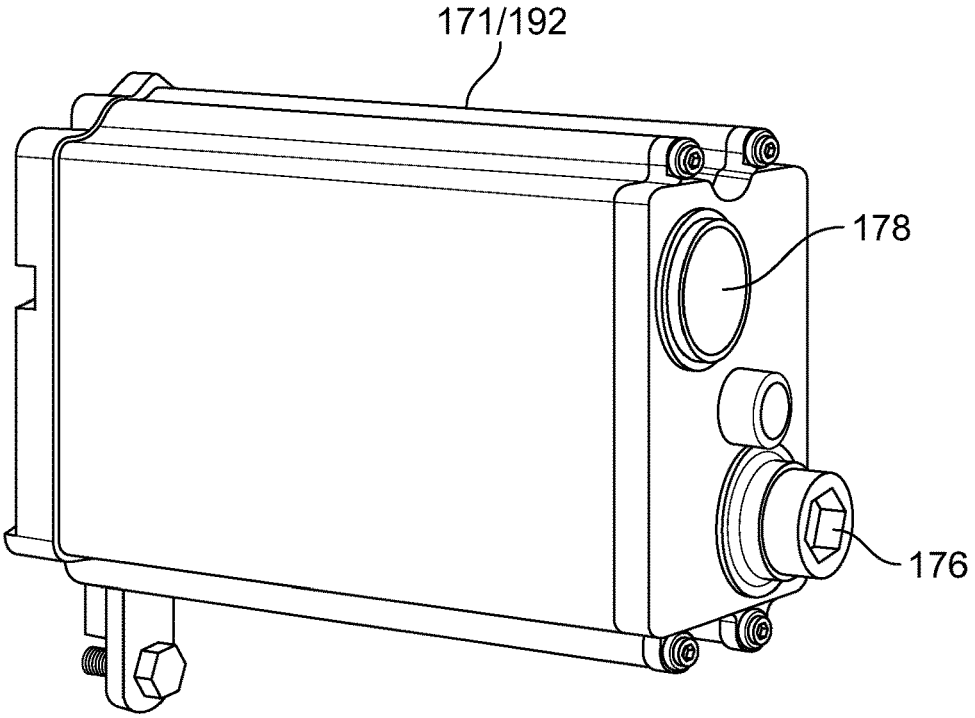
FIG. 4A is an illustration of an exemplary AISG antenna control unit (ACU)
Figure 4B:
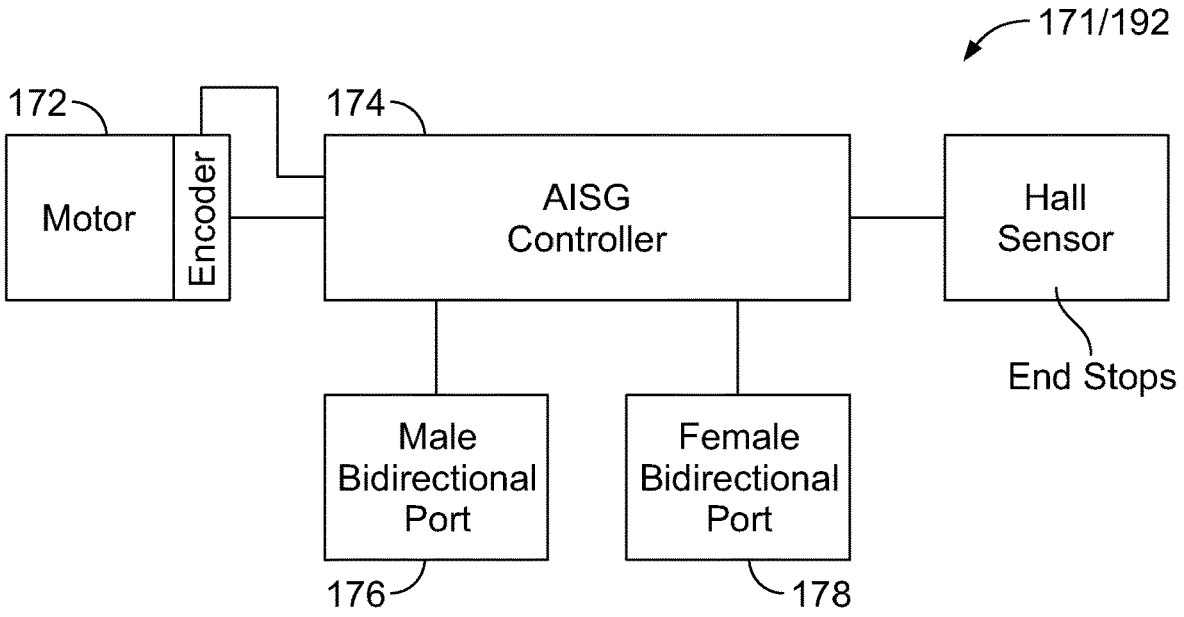
FIG. 4B is a schematic illustration of an ACU.

Referring to FIGS. 4A and 4B, an exemplary motor control unit 171 is illustrated. In some embodiments this motor control unit 171 may be a control unit that comprises a motor 172, an AISG motor control processor 174, a position sensor 175 and male 176 and female 178 AISG bidirectional ports. The bidirectional ports allow these control units to be serially interconnected and monitored and controlled as a single system. In some embodiment which are not required to drive a significant weight, these may be the same ACU units 104 which are installed on the antenna 102 to control the internal antenna signal phase. As will be described in later embodiments, heavier antennas may require more robust drive systems including larger motors and higher gear ratios for improved torque and rotational stability under wind load. In either case, whether standard control units or proprietary control units are utilized, the AISG motor control systems allow the units to be operated and controlled with the same software and interfaces already in place at the local Node 14 and/or the carrier NOC 16.

Figure 1:
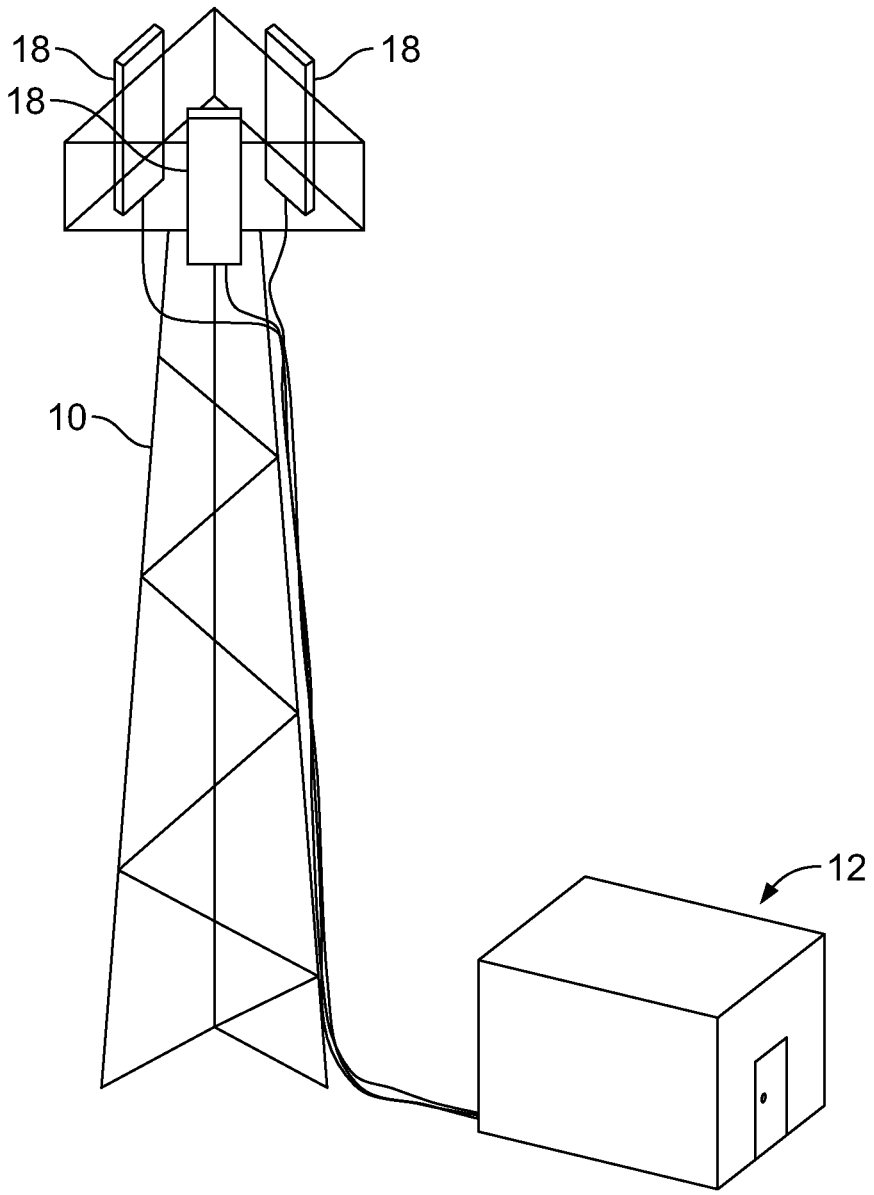
FIG. 1 (PRIOR ART)
FIG. 1A is a schematic illustration of a telecommunication tower installation.
Figure 2A:
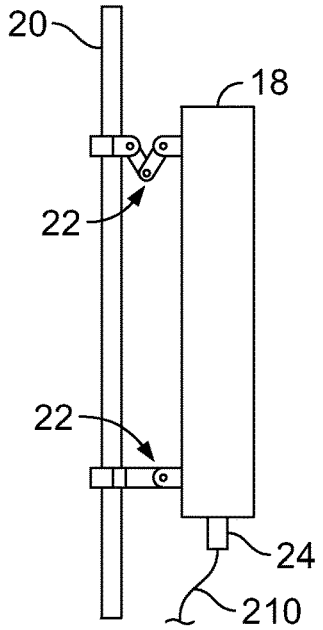
FIG. 2A (PRIOR ART)
FIG. 2A is an illustration of a prior art antenna and mount including a manual downtilt bracket installed on a mount post.
Figure 2B:
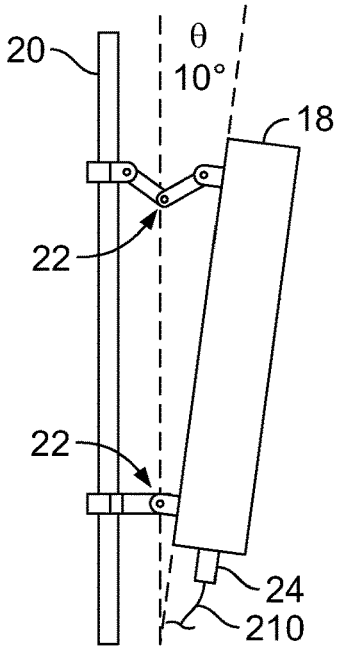
FIG. 2B (PRIOR ART)
FIG. 2B is a similar illustration thereof with the downtilt bracket extended.
Figure 2C:
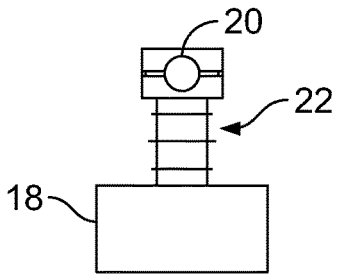
FIG. 2C (PRIOR ART)
FIG. 2C is a top illustration thereof showing the mount bracket and antenna clamped at a 0° azimuth position.
Figure 2D:
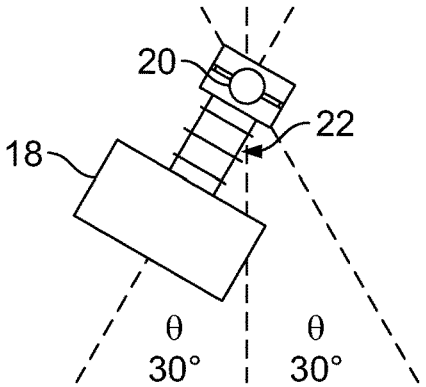
FIG. 2D (PRIOR ART)
FIG. 2D is another top illustration thereof showing the mount brackets and antenna clamped at a 30° azimuth position.
Figure 3:
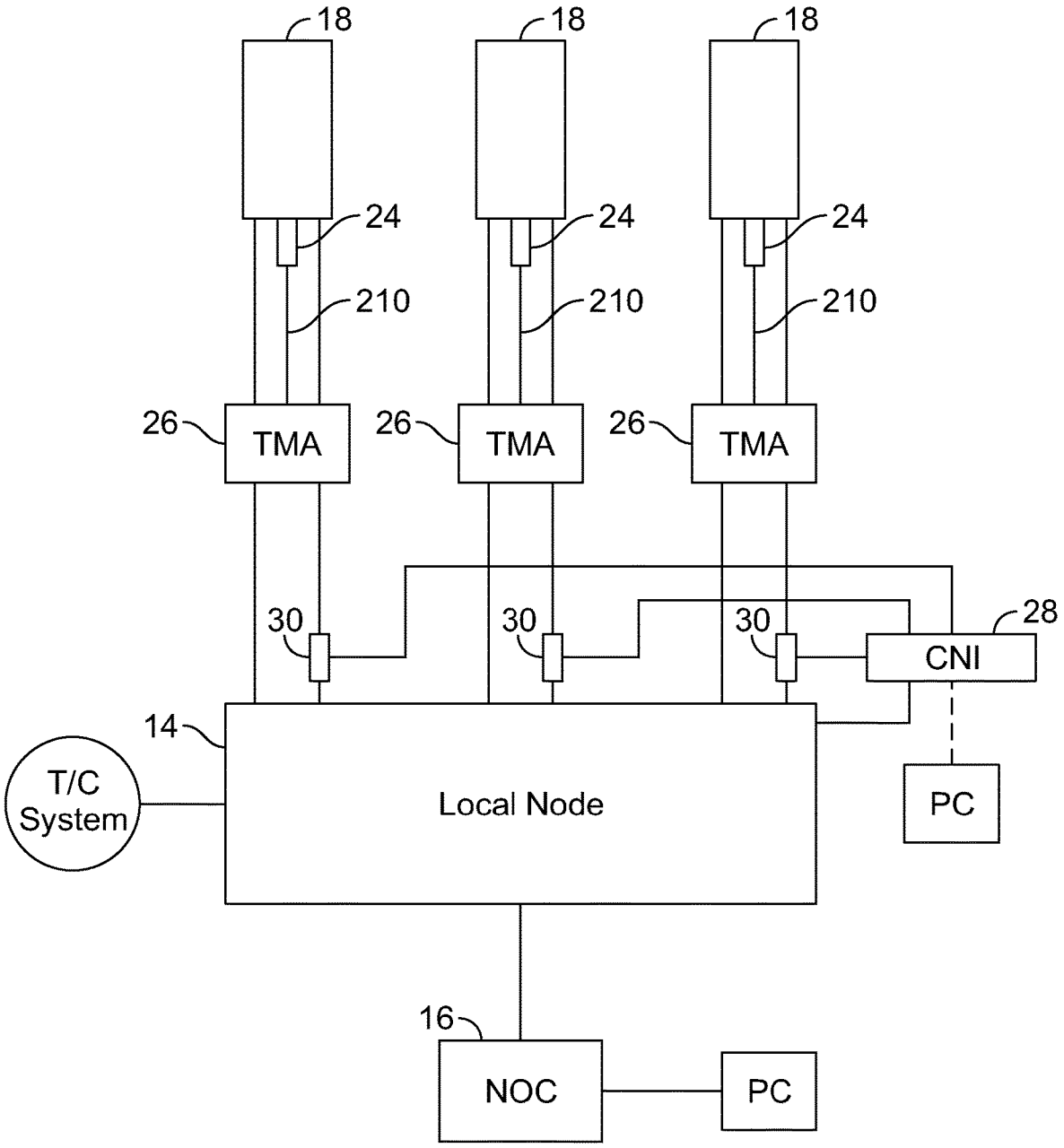
FIG. 3 (PRIOR ART)
FIG. 3 is a schematic view of a prior art AISG compatible tower installation.
Figure 5:
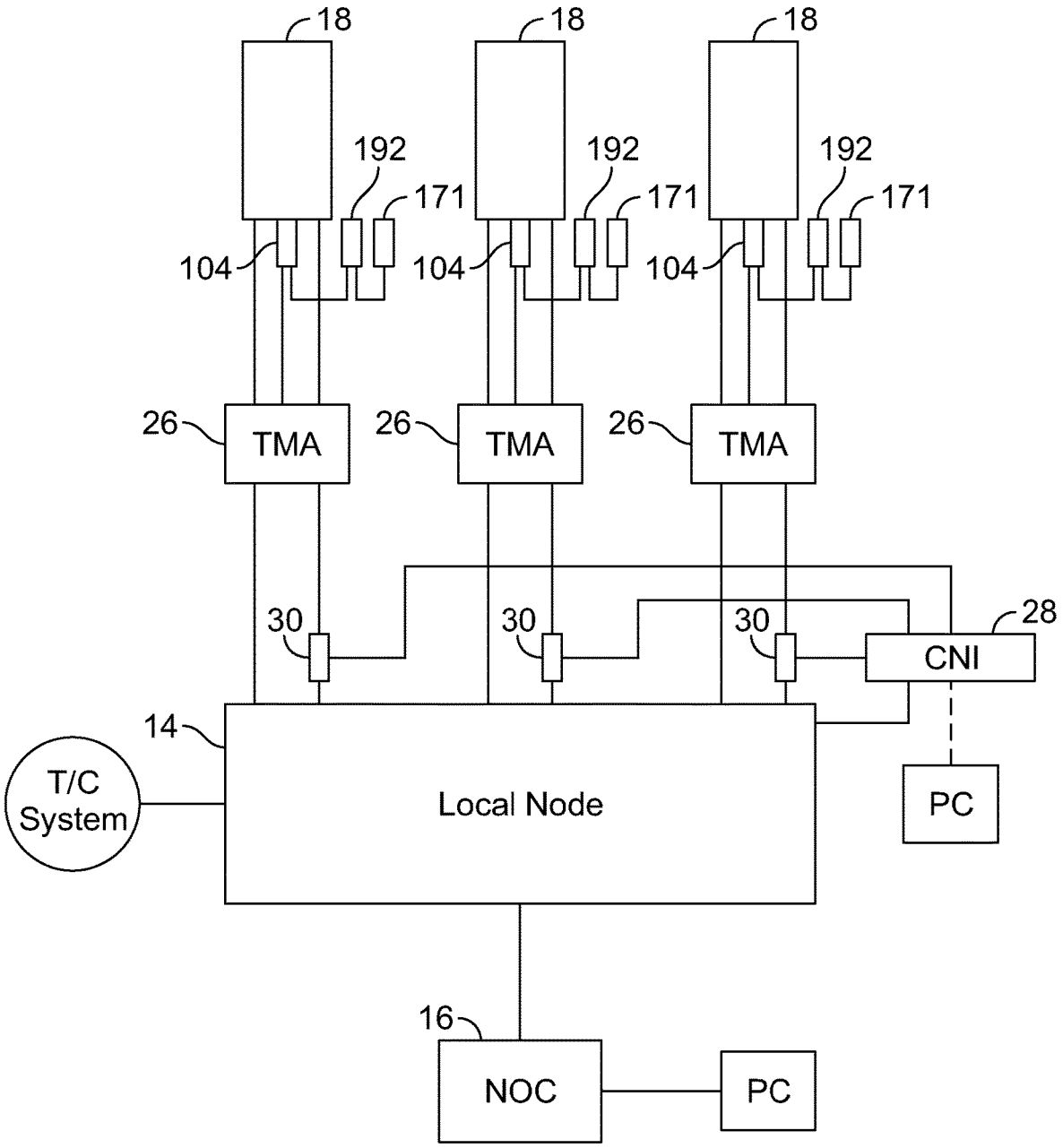
FIG. 5 is a schematic view of an AISG tower installation including 3 antennas and antenna mounts according to the present invention.

Referring to FIG. 5, an exemplary T/C system is illustrated. Building on the prior art system of FIG. 3, the present improved system may include a plurality of antennas 102, and each may have at least one on-board ACU 104. The ACU's 104 are connected to, and can be controlled from, the local CNI 28 and the NOC 16 as previously described. According to the teachings of the present invention, an external Mount Azimuth Control Unit (MACU) 171 and the Mount Tilt Control Unit (MTCU) 192 are serially connected with the ACU 104 with AISG serial cables 210 to provide serial control of all of the control units 104, 171, 192 through the existing AISG infrastructure. In this regard, the antenna installed control unit(s) 104 will control "electronic tilt" of the antenna, while the MACU and MTCU will control the "physical" position of the entire antenna. The present solution thus provides the ability to both physically aim the antenna to adjust coverage area (MACU and MTCU) and also the ability to adjust the signal phase to fine tune the quality of the signal (ACU).

An exemplary embodiment of the present antenna mount may include an azimuth adjustment assembly generally having a structure side interface 108 which is configured to be mounted to a mounting pole 110 or other structure, and an antenna side interface 112 which is configured to be mounted to the antenna 102. As indicated above, many antennas 102 are mounted on towers and monopole structures which provide a vertical pole 110 for mounting of the antenna 102. While the exemplary embodiments described herein are intended for mounting on a pole structure 110, the scope of the invention should not be limited by these illustrations. The structure side interface 108 can be adapted and modified as needed to be secured to many different types of structures, and could include brackets, connectors, magnets, etc. as needed for flat surfaces, curved surfaces, etc.

Figure 7:
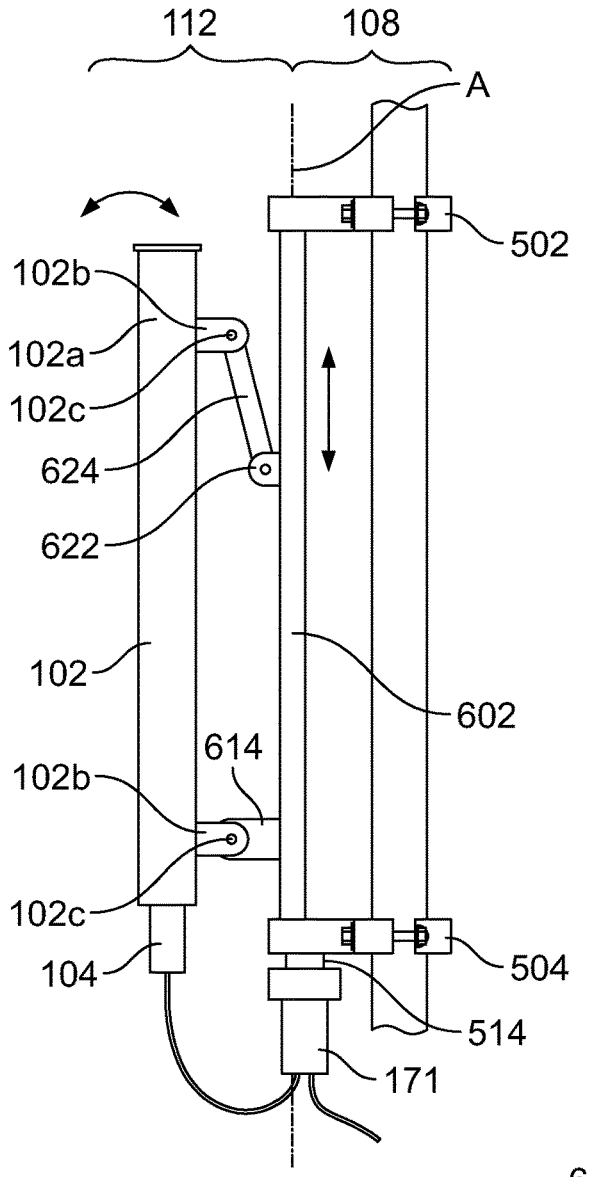
FIG. 7 is a side view thereof.
Figure 12:
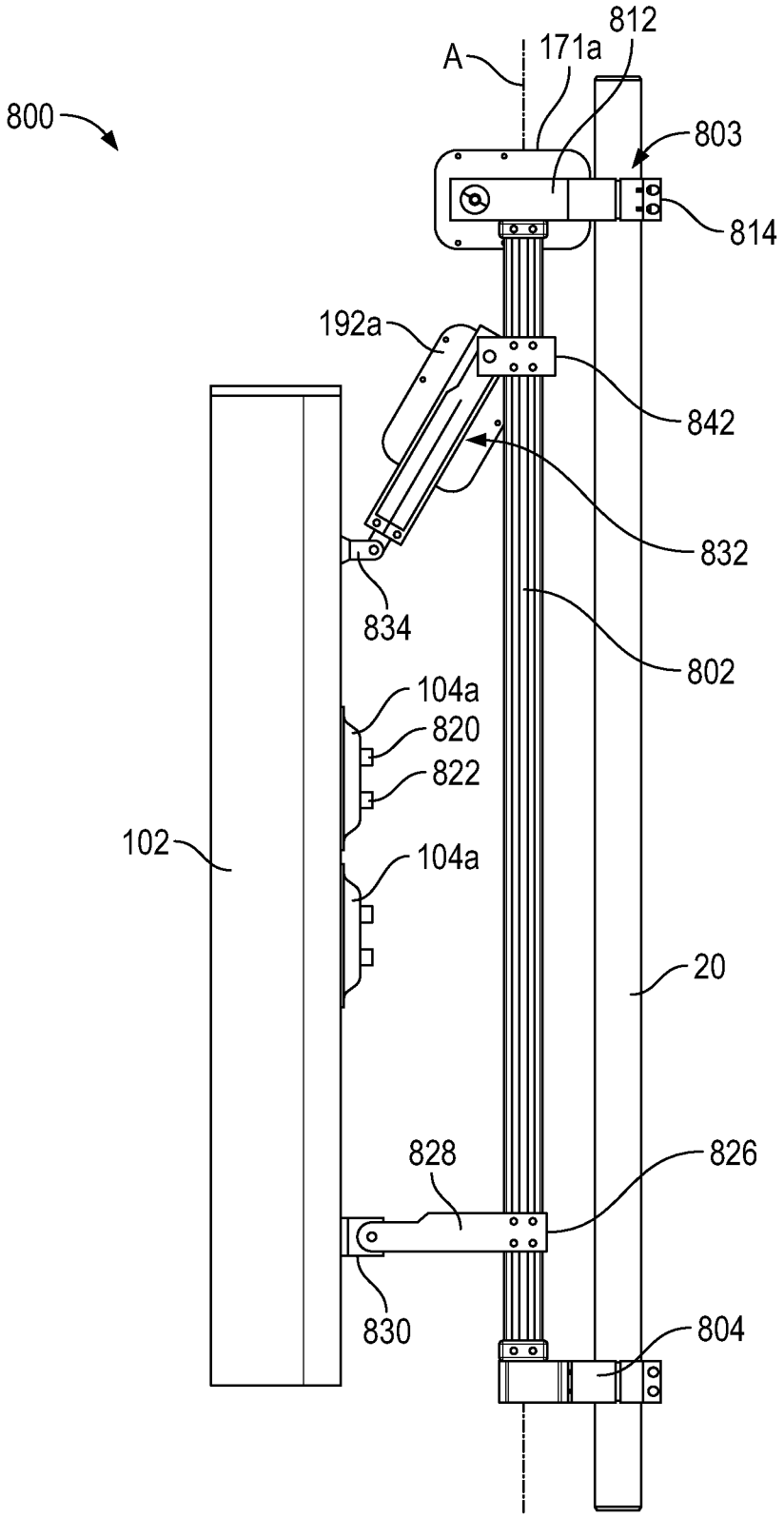
FIG. 12 is a side view thereof.
Figure 13:
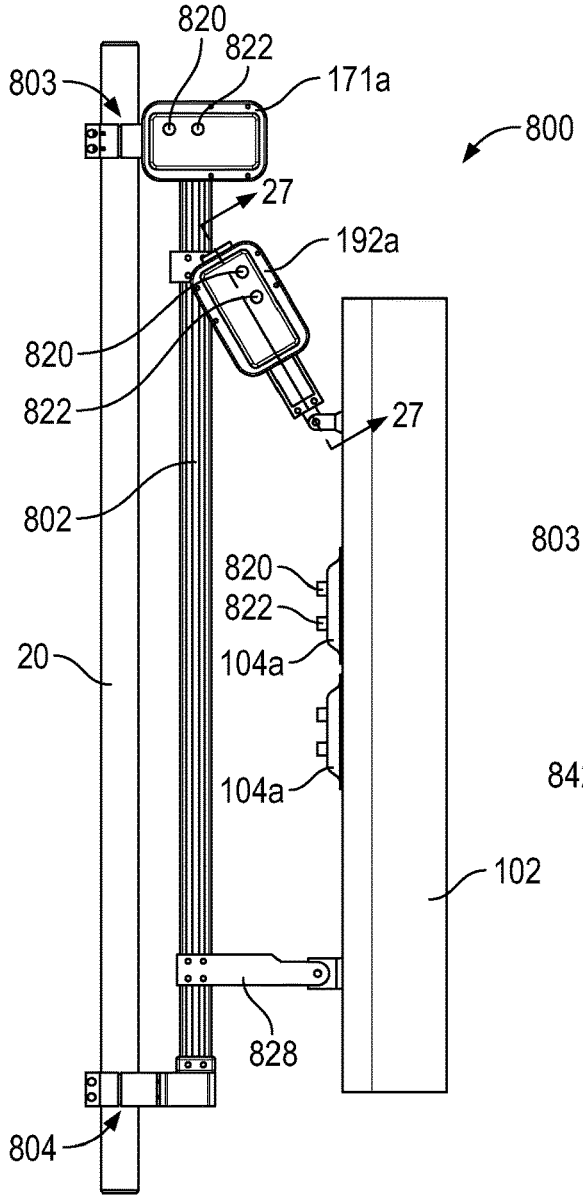
FIGS. 13-14 are additional side views showing the antenna in a full upright position and a mechanically actuated 15 degree downtilt position.
Figure 14:
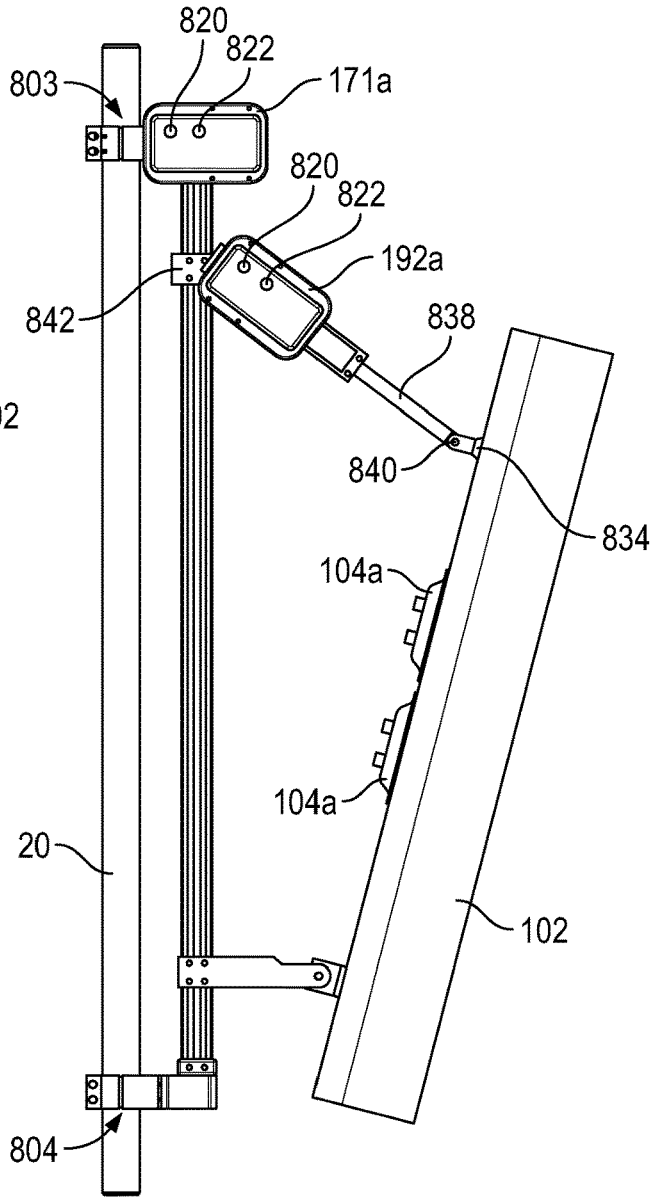
Figure 15:
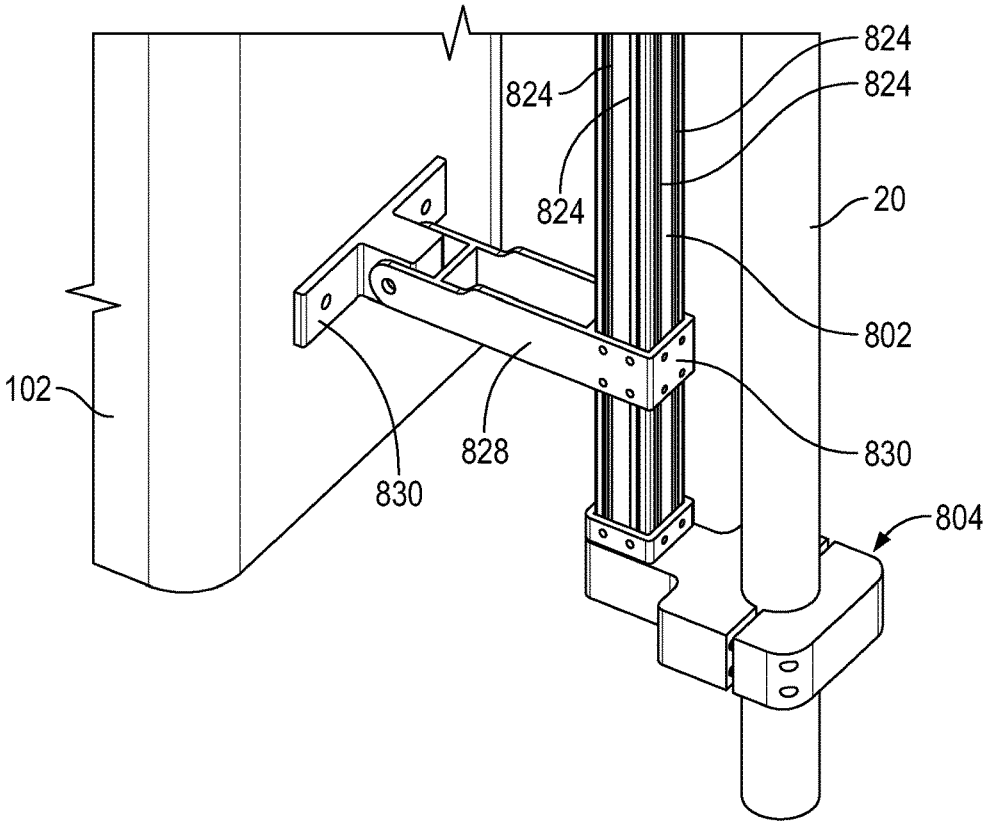
FIG. 15 is an enlarged perspective view of the lower rotation bracket, mast and lower downtilt pivot bracket.
Figure 16:
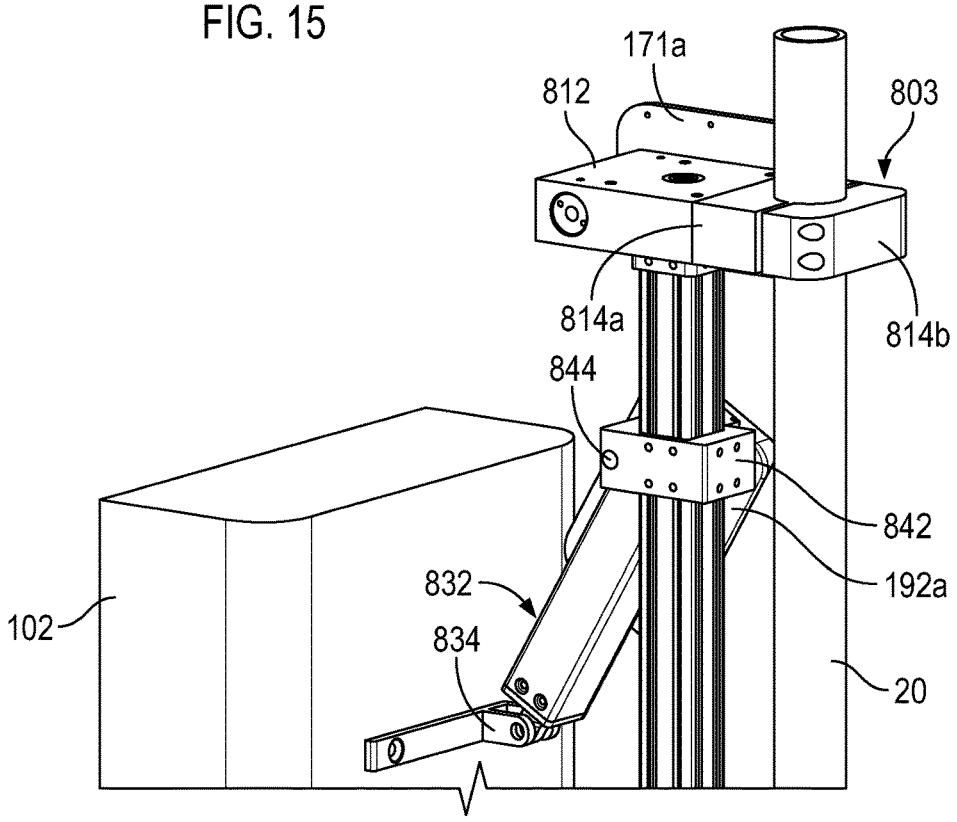
FIG. 16 is an enlarged perspective view of the gear reduction drive for azimuth rotation, mounting bracket and the linear actuator drive for downtilt pivotably secured to the mast and upper portion of the antenna.
Figure 17:
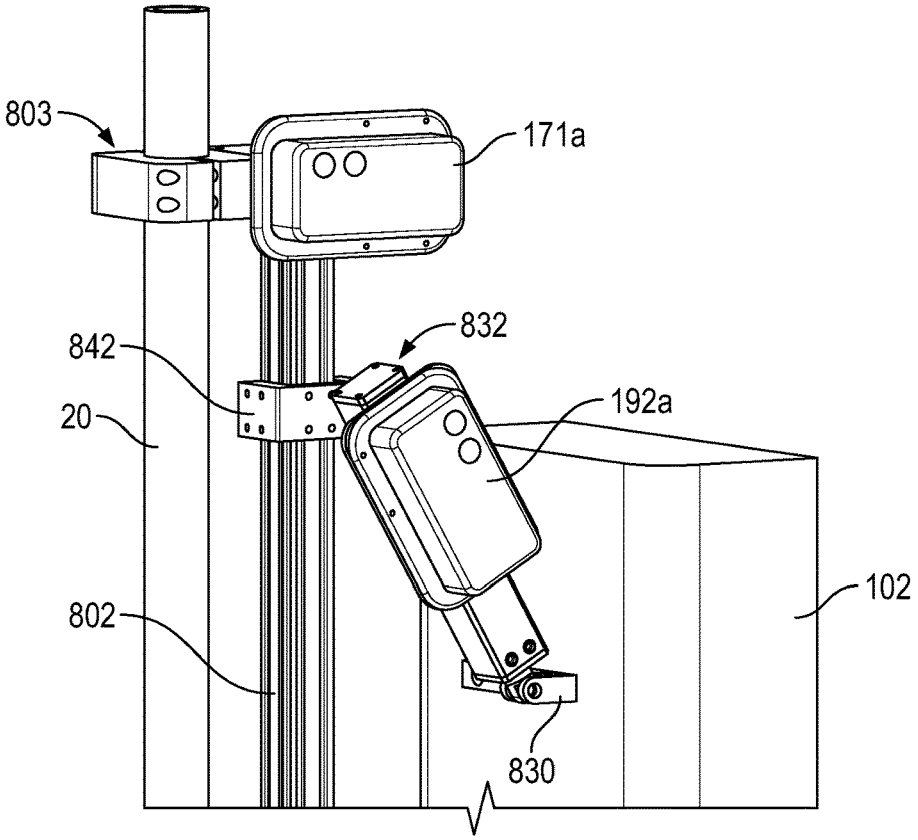
FIG. 17 is an enlarged perspective view thereof from another angle.
Figure 18:
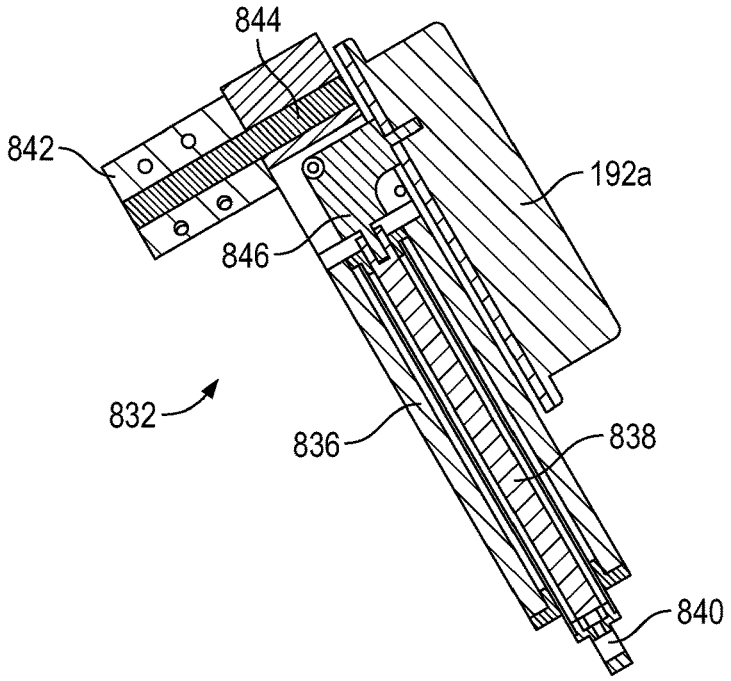
FIG. 18 is a cross-sectional view of the linear drive rod, MTCU motor controller, right angle drive coupling and mast bracket.
Figure 19:
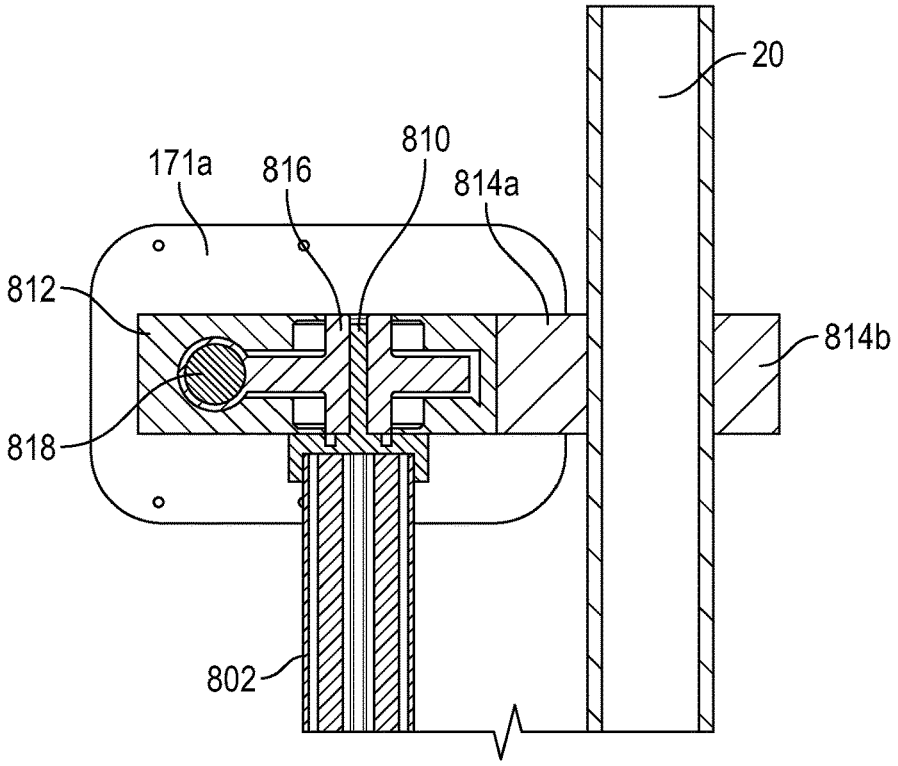
FIGS. 19 and 20 are cross-sectional views thereof taken along line 19-19 and 20-20 of FIG. 11.

The structure side interface 108 and the antenna side interface 112 are rotatable relative to each other through upper and lower pivot connections aligned along a vertical axis A (See FIGS. 7 and 12). The upper and lower portions of the mount 100 are generally separated into two discreet upper and lower units and to provide the ability to adjust the location of the mount portions relative to the back of the antenna 102. As described above, while most antennas 102 have a standard connection spacing, there is a significant amount of variability and thus a need to have the two portions of the mount separate. However, if designed for a single standard size spacing which is known, the upper and lower portions of the structure side interface 108 could be connected by an elongate body to provide a single unit. The same is true for the antenna side interface 112.

Figure 6:
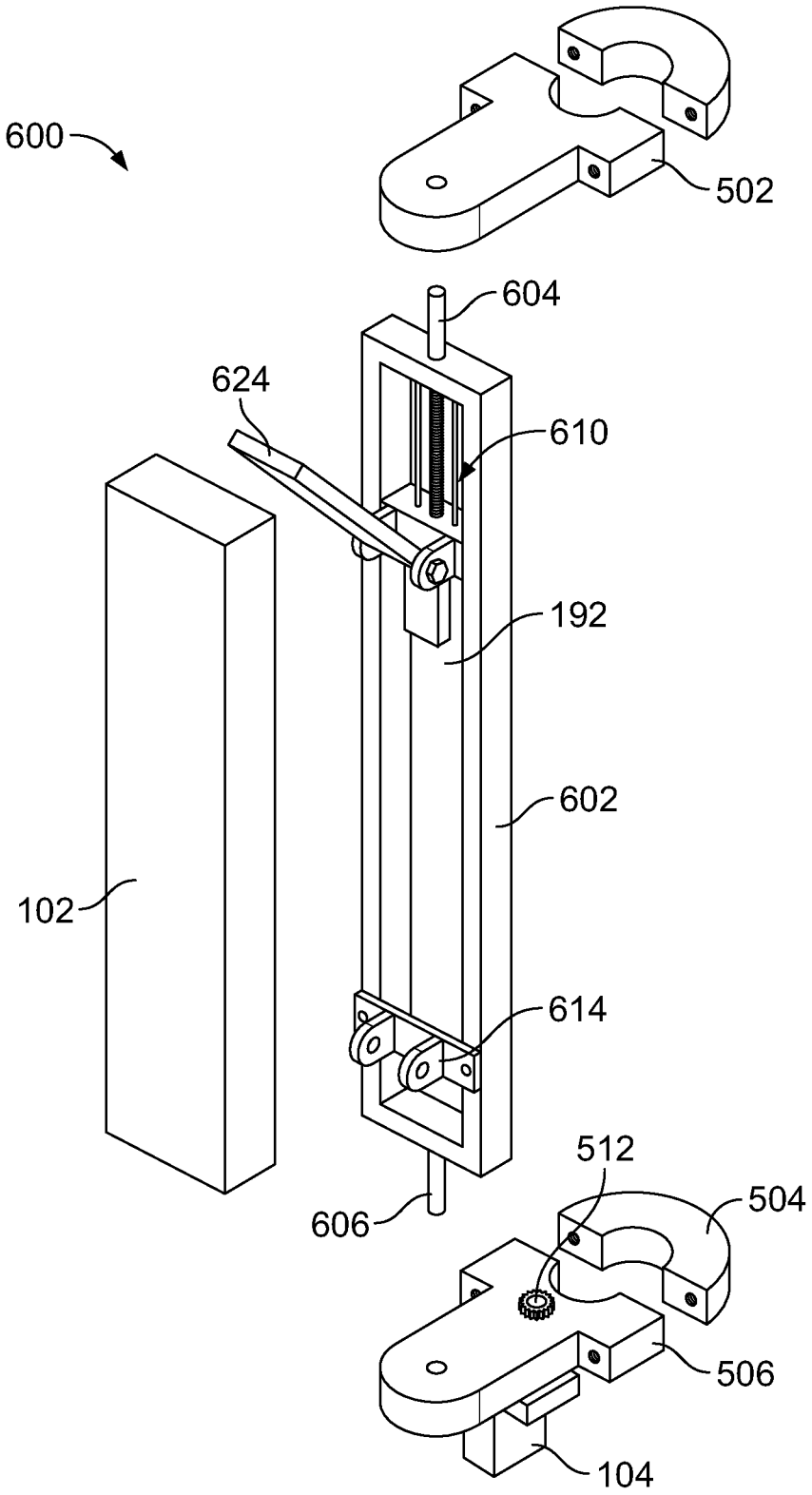
FIG. 6 is an exploded view of yet another exemplary embodiment with an improved back frame and linear drive assembly.
Figure 8:
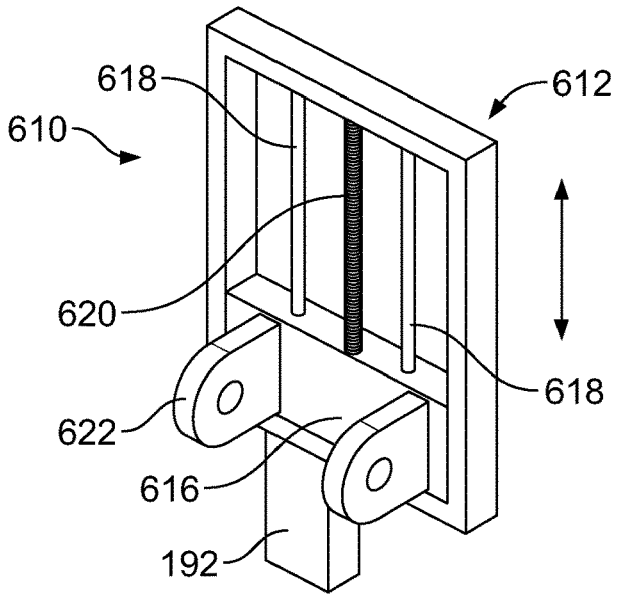
FIG. 8 is an enlarged view of an exemplary linear tilt drive sub-assembly.

Referring now to FIGS. 6-8, an exemplary embodiment 600 includes an antenna mounting frame 602 having pivot pins 604 and 606 on the top and bottom of the frame 602. The antenna 102 is mounted to the frame 602 and rotation of the frame 602 is driven and controlled by an MACU 171 mounted on a lower clamping mount (504/506). The lower pivot pin 606 includes a follower gear (not shown) which is driven by a geared drive mechanism 514. The drive shaft 512 is the output shaft of a gear reduction unit 514 which is secured below the mount body 506. The MACU 171 is coupled to the input end of the gear reduction unit 514 to drive rotation.

The frame 602 provides a rigid stable platform to secure the antenna 102 and reduces upper end wobble associated with using two separate upper and lower swivel bodies. The frame 602 is adaptable in size for different size antennas and can be universally adapted for connection to different antennas using different adapter connections.

A linear drive system 610 which may reside in a sub-frame 612 received within the upper portion of the antenna frame 602. The frame 602 includes a fixed pivot hinge 614 on the lower portion of the frame 602. The fixed pivot hinge 614 is adjustable in location along the length of the frame 602 to accommodate different size antennas 102.

The linear drive system 610 includes a linear drive block 616 which rides on two spaced guide rods 618. The MTCU 192 is mounted to the lower portion of the sub-frame 612 and drives a threaded drive rod 620 received through the drive block 616 to drive linear up and down motion of the linear drive block 616. The top of the antenna 102 is secured to a pivot hinge 622 on the drive block 616 through a tilt arm 624 which is also pivotably secured to a bracket on the rear of the antenna. It can therefore be seen that linear upward movement of the drive block 616 extends the tilt arm 624 and pushes the top end of the antenna 102 outwardly to provide a controlled downtilt of the antenna 102. The linear sub-frame 612 is adjustable in location within the main frame 602 for different size antennas and different mounting needs. The upper and lower mount bodies 504 and 506 are still independently adjustable in location on the pole.

The rigid antenna frame 602 improves rotational stability to the system while the linear tilt drive also improves stability of the system. The frame 602 further provides a platform for the installation of other antenna accessories, or more importantly RF shielding material (not shown). It is becoming more evident that RF back lobe emissions are becoming an issue on overcrowded tower structures and carriers are seeking ways to absorb RF emitted from the rear side of their antennas. The frame 602 provides an ideal location for the installation of RF shielding or RF absorbing materials.

Figure 9:
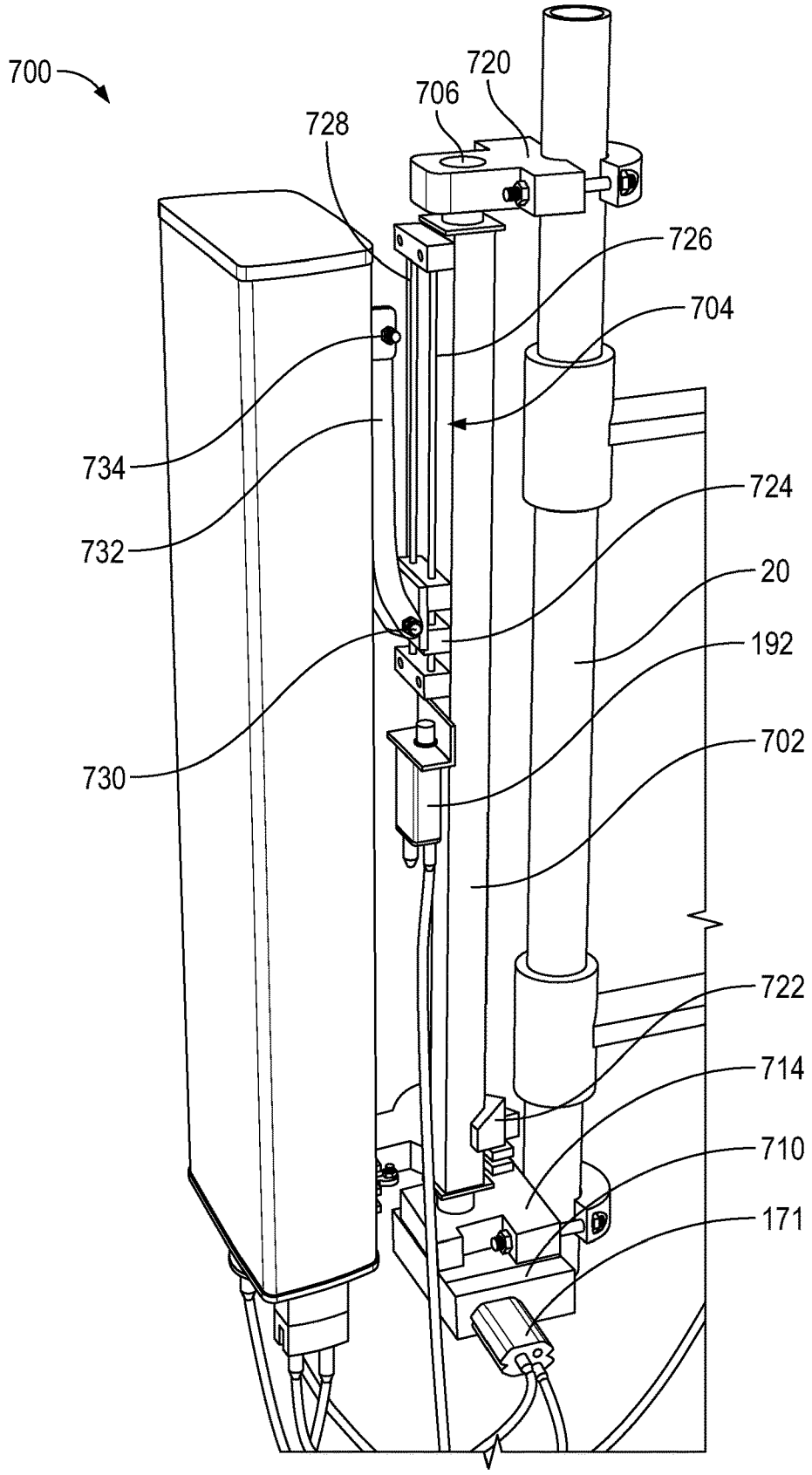
FIG. 9 is a perspective view of yet another exemplary antenna mount assembly include a pivoting mast and linear actuator assembly.
Figure 10:
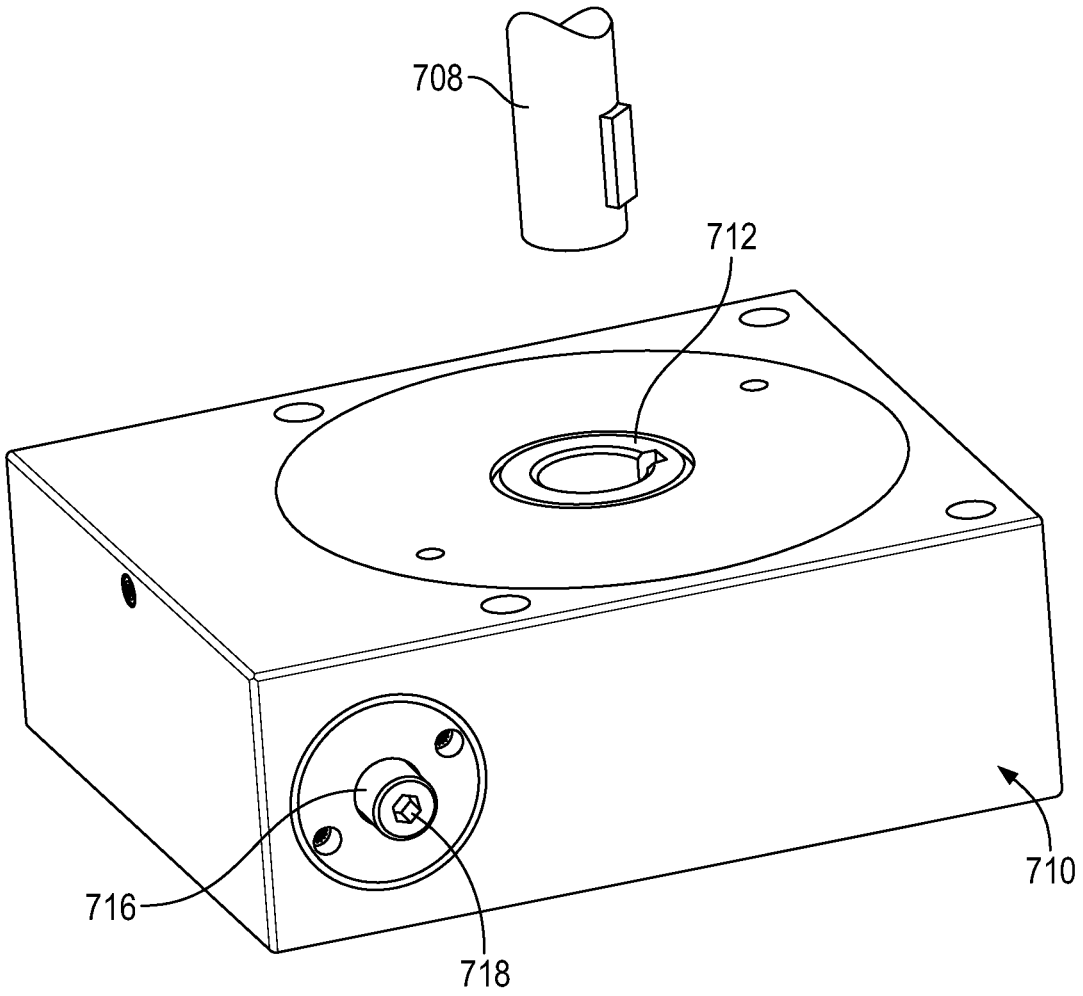
FIG. 10 is an enlarged view of a gear reduction used to drive rotation of the mast in the assembly of FIG. 9.
Figure 11:
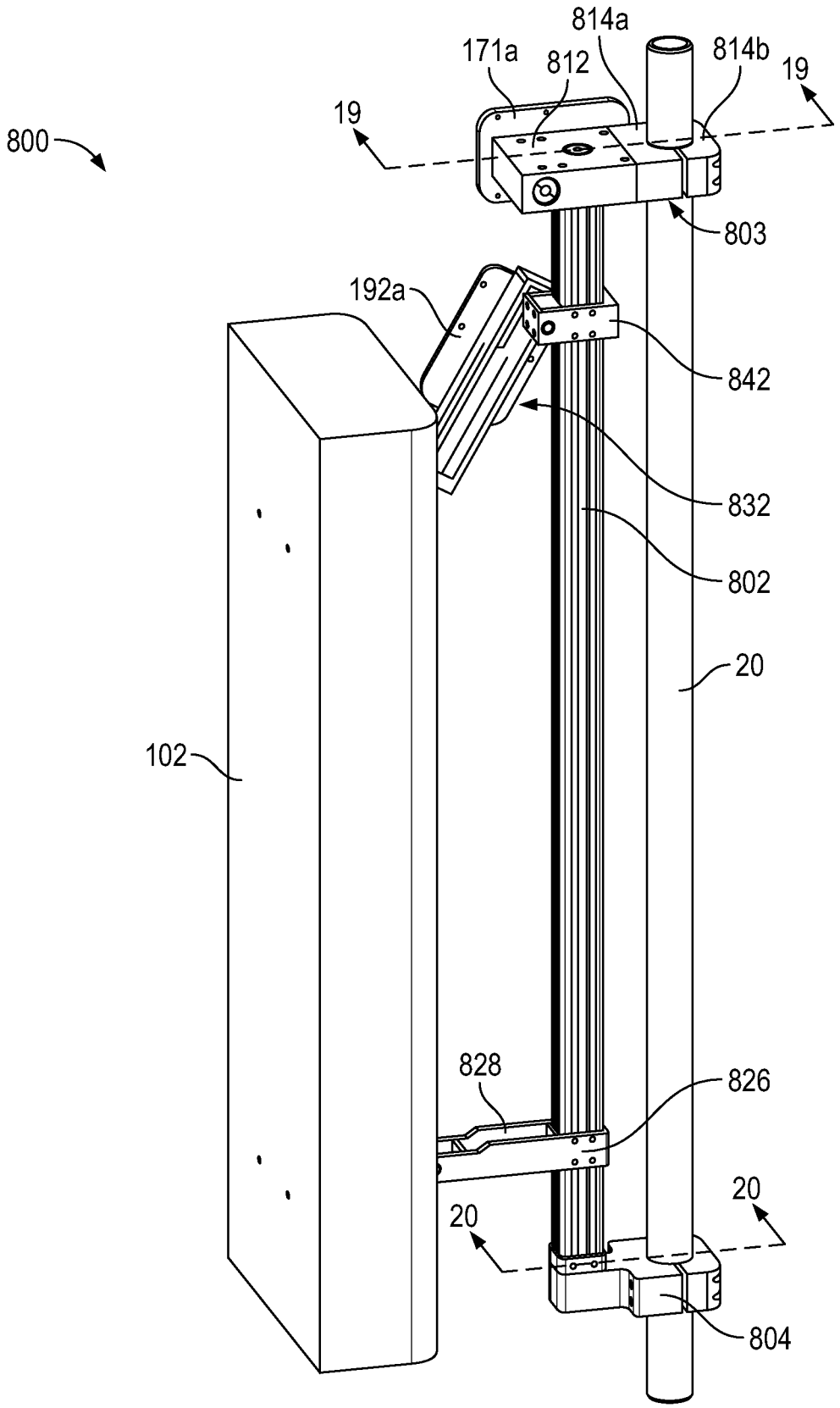
FIG. 11 is a perspective view of an exemplary embodiment with the azimuth control drive mounted at the top of the assembly and including a linear actuator pivotably mounted between the mast and the upper portion of the antenna.
Figure 20:
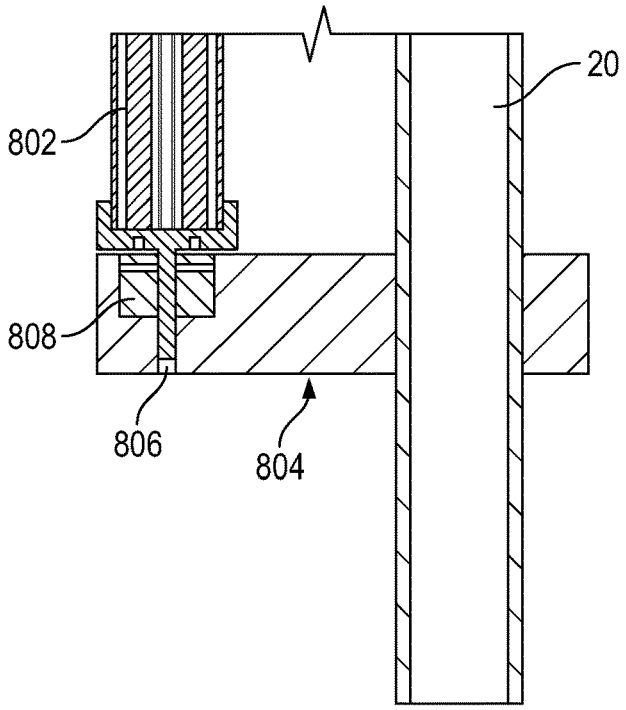
Figure 21:
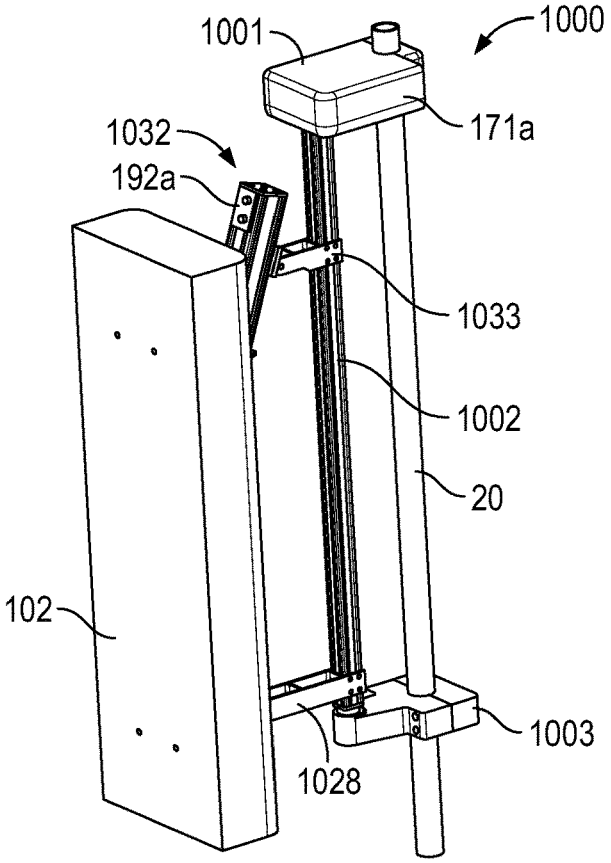
FIGS. 21-33 illustrate another embodiment with the azimuth rotation system and clamp mount integrated into a single drive unit and the linear actuator drive fully self-contained within a tubular housing.
Figure 22:
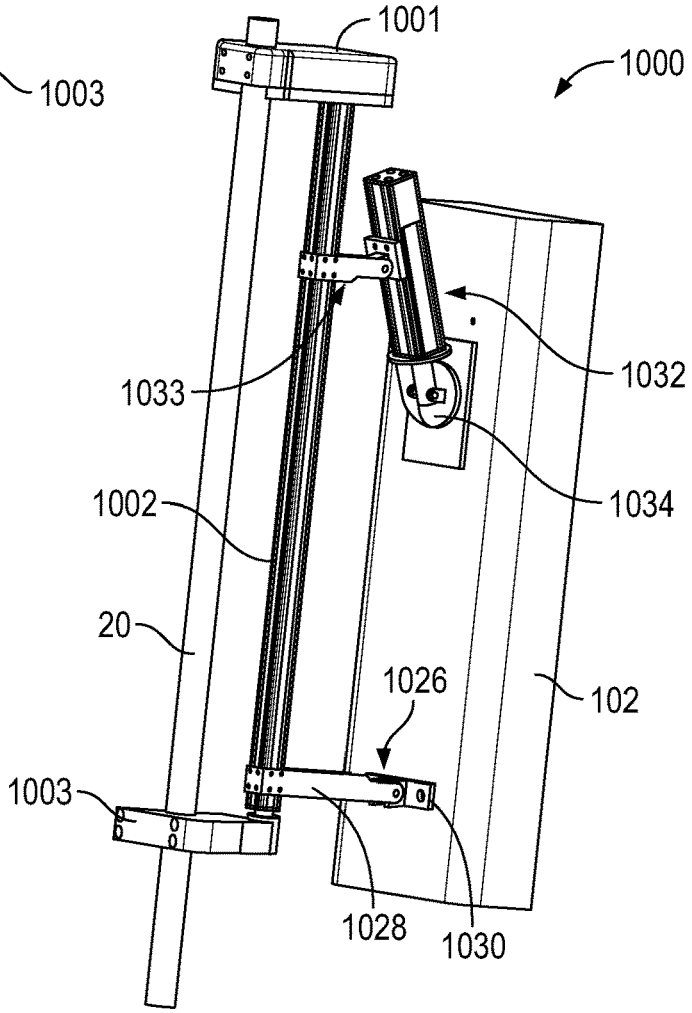
Figure 23:
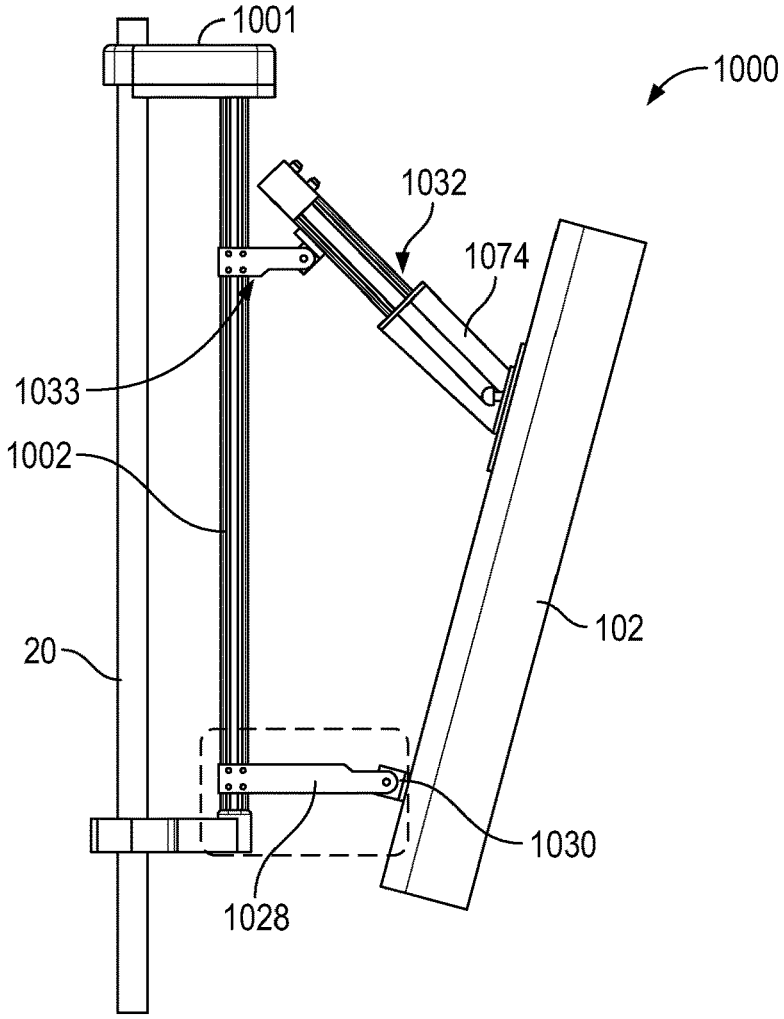
Figure 24:
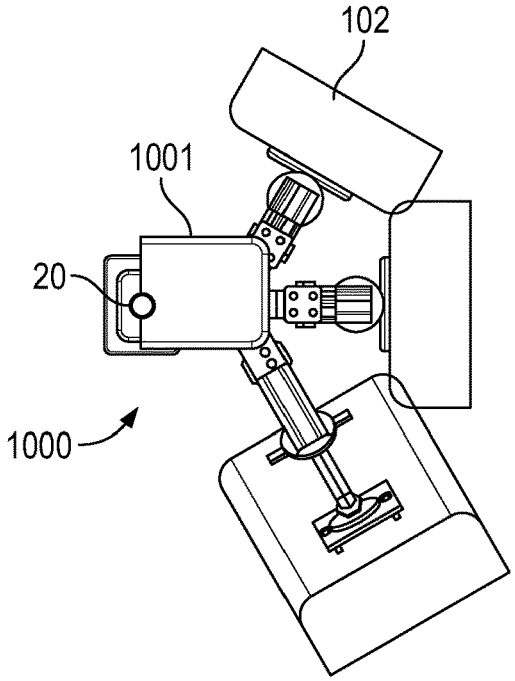
Figure 25:
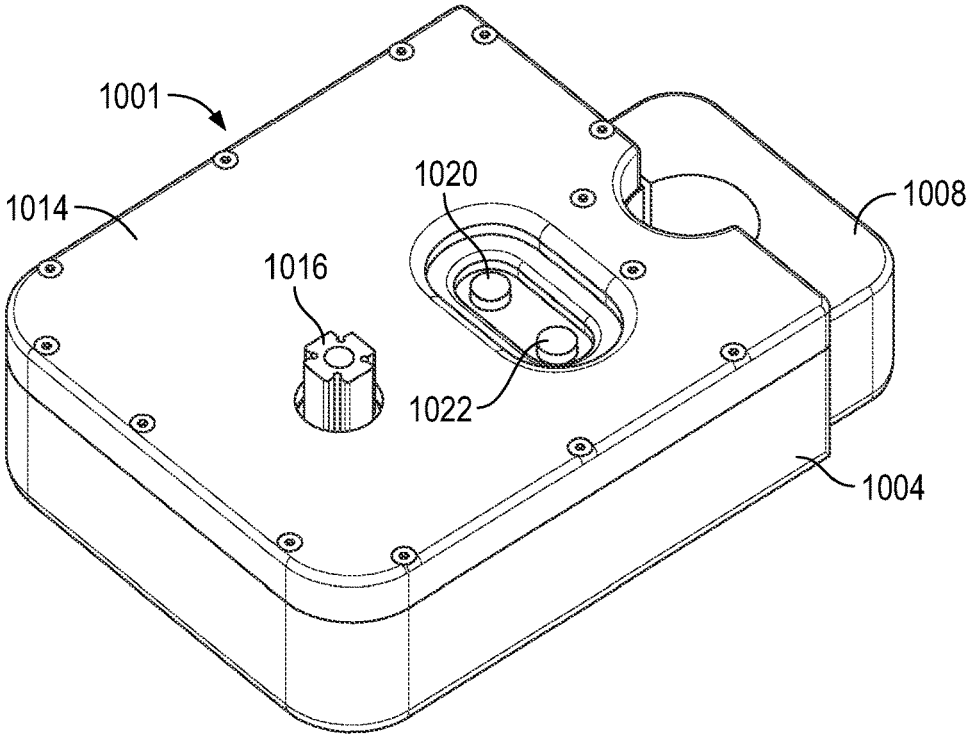
Figure 26:
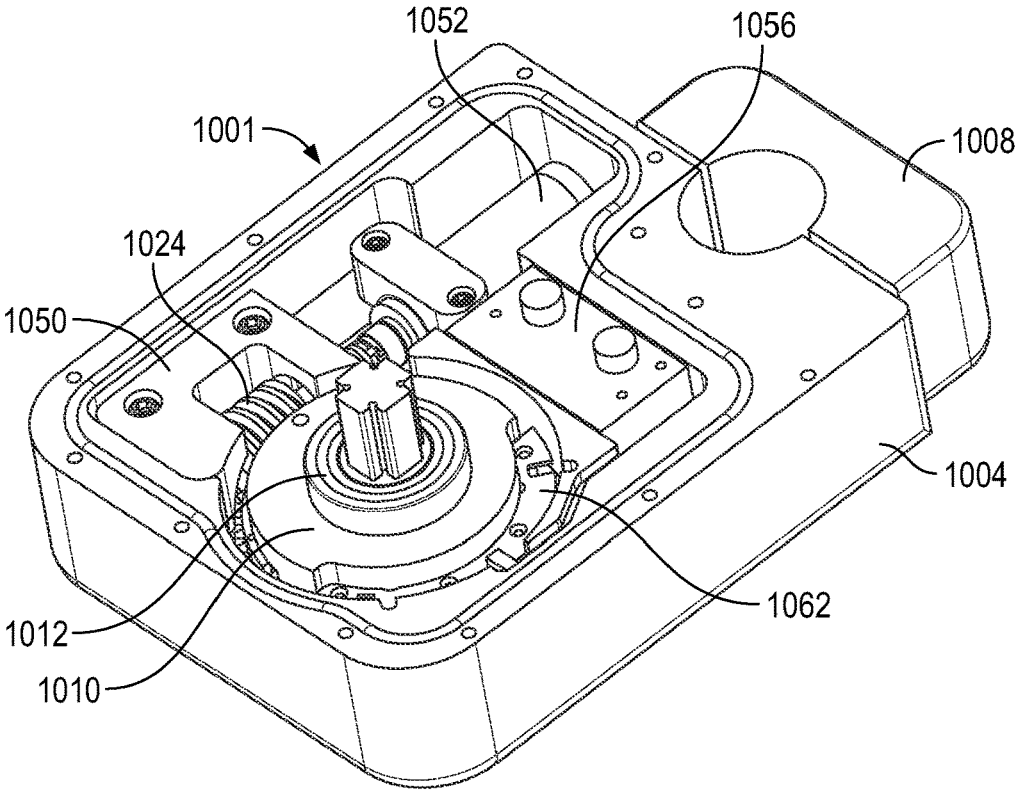
Figure 27:
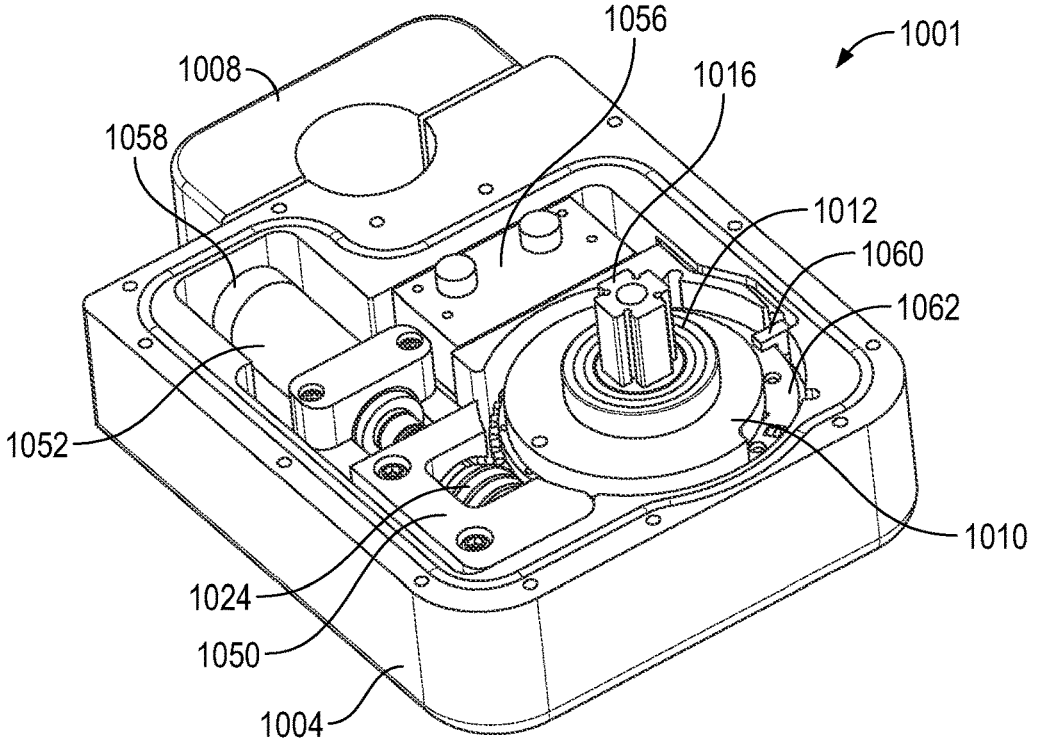
Figure 28:
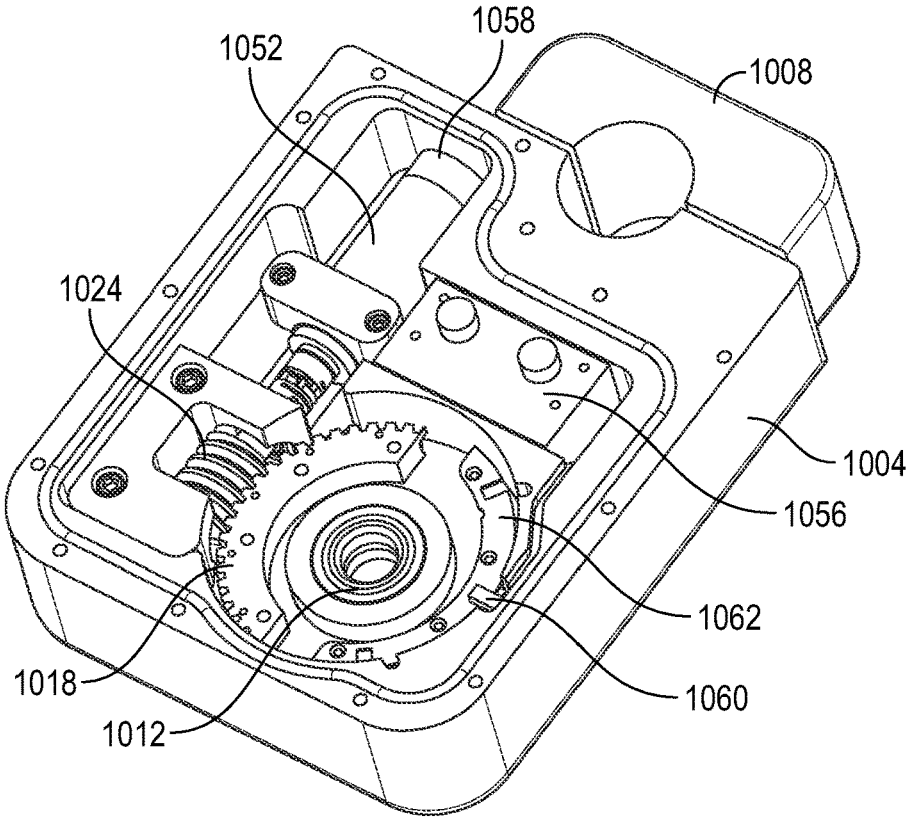
Figure 29:
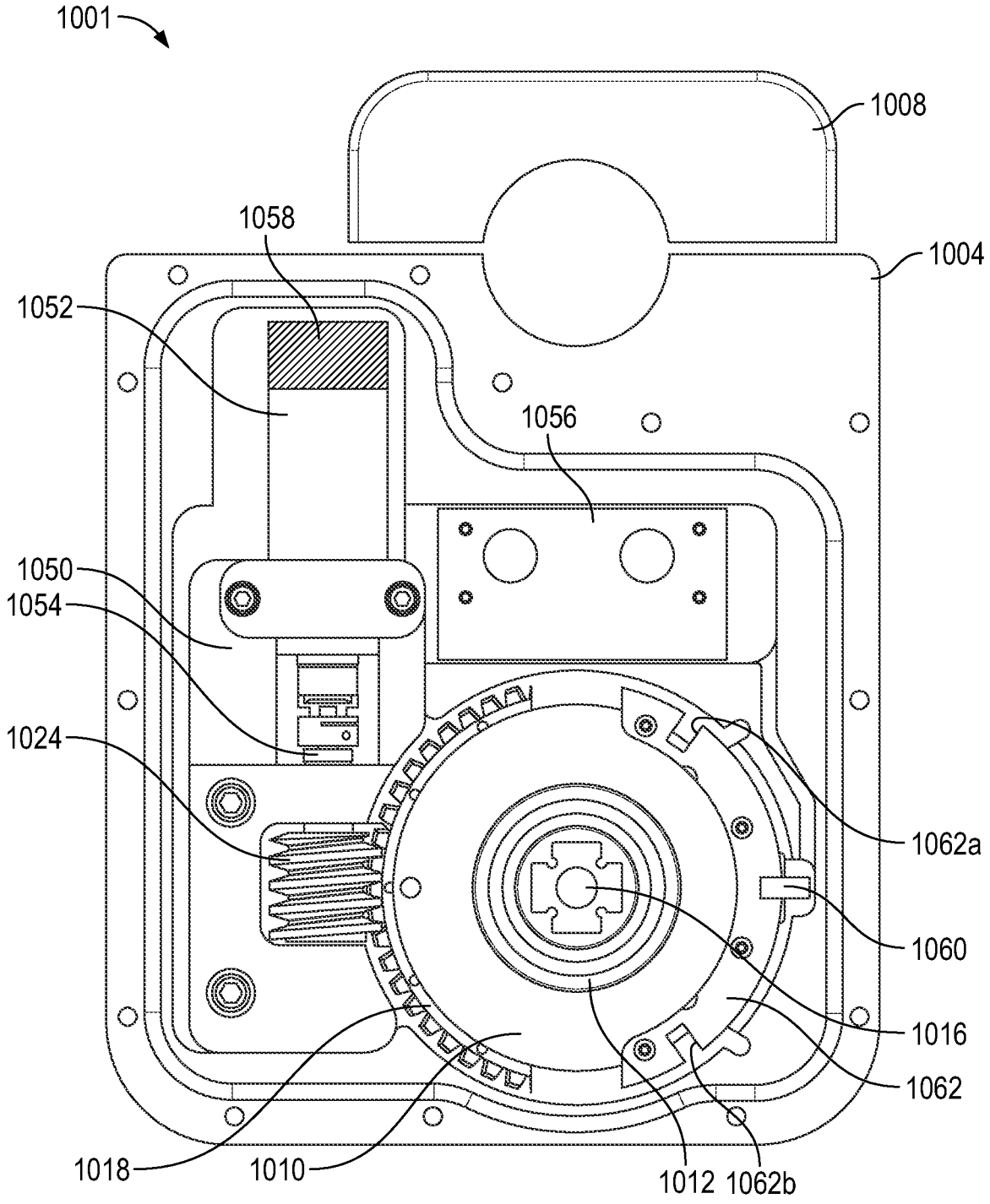
Figure 30:
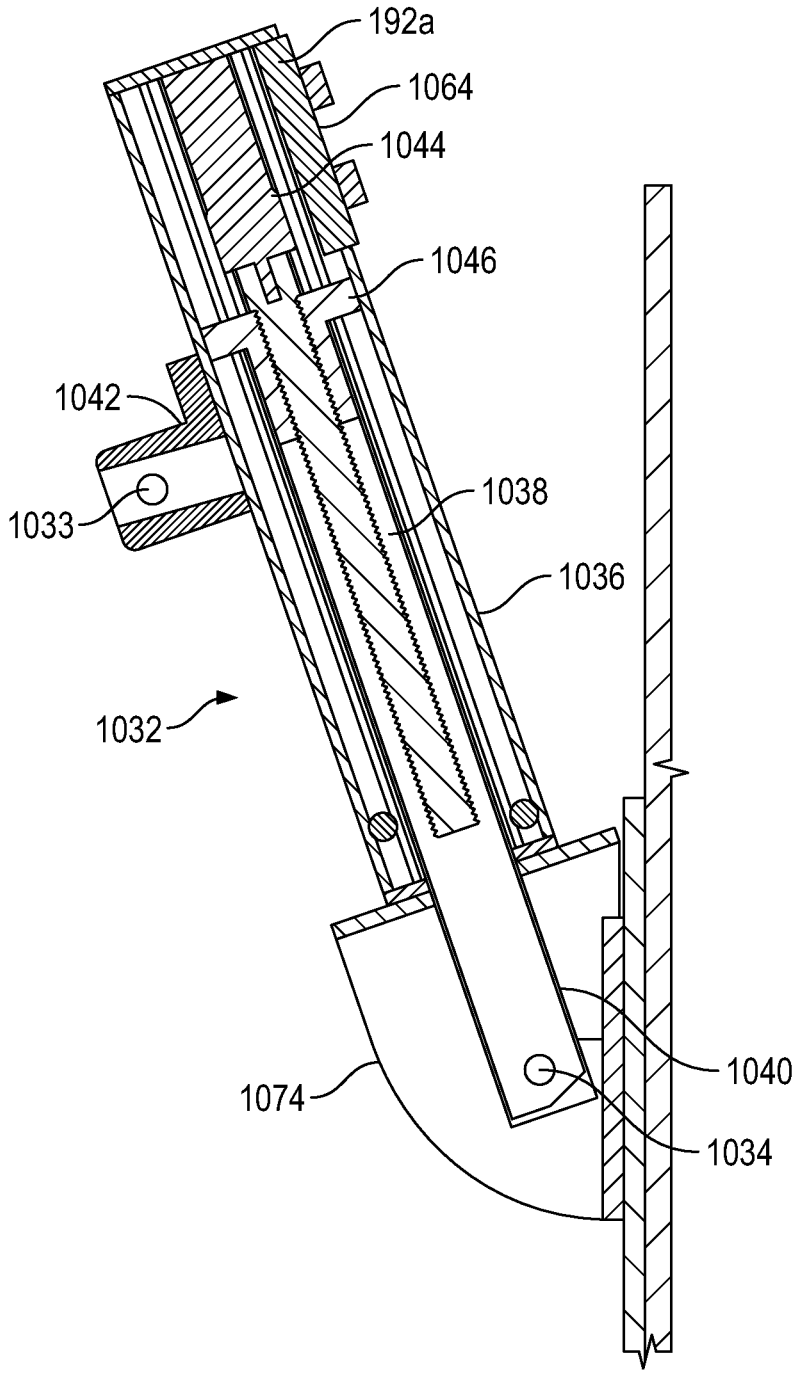
Figure 31:
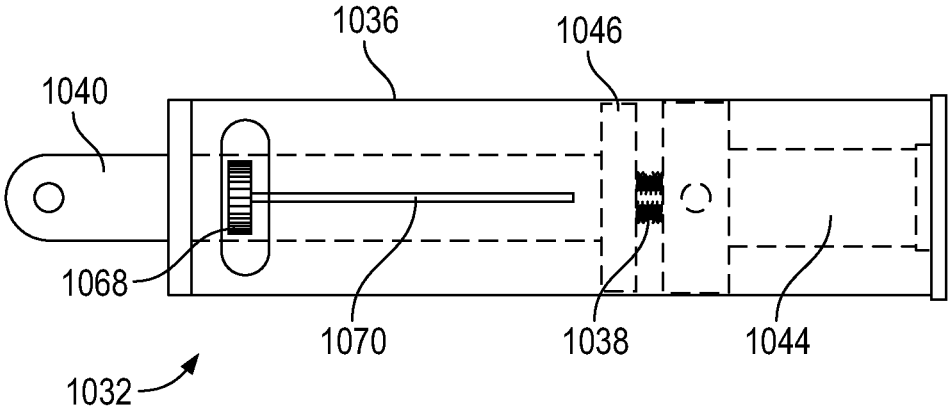
Figure 32:
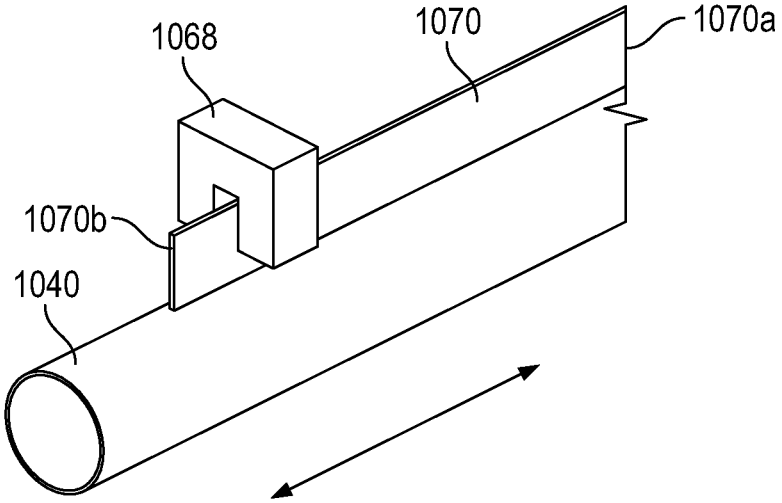
Figure 33:
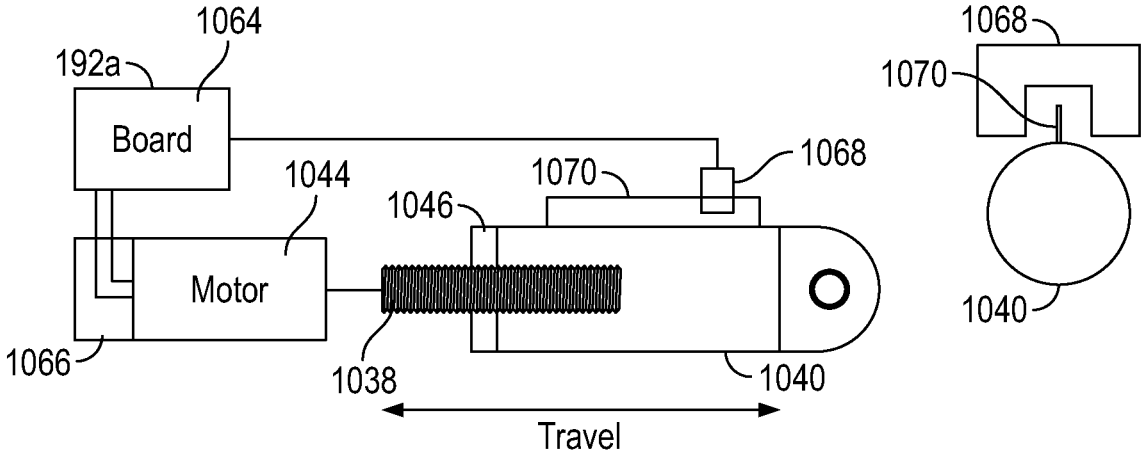

Referring to FIGS. 9-10, in another exemplary embodiment 700, the frame may be replaced with a linear mast 702 on which linear actuator sub-assembly 704 can be mounted. The mast 702 includes upper and lower pivot pins 706, 708 on the top and bottom of the frame 702. The antenna 102 is mounted to the mast 702 and rotation of the mast 702 is driven and controlled in a similar manner with the MACU 171 and a gear reduction unit 710. The lower pivot pin 708 is a keyed shaft which is received into sealed worm gear reduction assembly 710 as best shown in FIG. 20. The gear reduction 710 may preferably comprise a 60 to 1 self-locking worm gear reduction with either reduced or zero backlash. The drive element (output) 712 is a keyed cylinder of the gear reduction unit 710 which is secured below the mount body 714. The keyed shaft 708 extends through the mount body 714 into the keyed output cylinder 712. Mount body 714 is clamped to the mounting post 20 as previously described. The MACU 171 is coupled to the input shaft 716 of the reduction unit 710 to drive rotation. The input shaft 716 is provided with 5 mm hex drive opening 718 to receive a like-sized hex drive pin of the MACU unit 171.

The upper pivot 706 is a similar 20 mm shaft received into a 20 mm bearing (not shown) supported in an upper clamped mount assembly 720 also clamped to mount post 20.

Like the frame 602 above, the mast 702 is adaptable in size for different size antennas 102 and can be universally adapted for connection to different antennas using different adapter connections.

The sub-frame linear drive 610 (above) is replaced with a dual guide linear actuator unit 704 having a backplane which may be secured to a forward face of the mast 702. A lower downtilt pivot bracket 722 is secured to the lower portion of the mast 702. The lower pivot bracket 722 is adjustable in location along the length of the mast 702 to accommodate different size antennas 102.

The linear drive actuator 704 includes a linear drive block 724 which rides on two spaced guide rods 726. The MTCU 192 is mounted to the lower portion of the actuator 704 and drives a threaded drive rod 728 received through the drive block 724 to drive the guide block 724 up and down spaced guide rods. The top of the antenna 102 is secured to a pivot hinge 730 on the drive block 724 through a tilt arm 732 which is also pivotably secured to a bracket 734 on the rear of the antenna 102. The linear upward movement of the drive block 724 extends the tilt arm 732 and pushes the top end of the antenna 102 outwardly to provide a controlled downtilt of the antenna 102 as in the previous embodiment. The linear actuator sub-assembly 704 is adjustable in location on the mast 702 for different size antennas and different mounting needs. The upper and lower mount bodies 714 and 720 are still independently adjustable in location on the mounting pole 20.

Some embodiments of the system may include only the azimuth drive system and either mechanical downtilt brackets or a fixed upper and lower mount brackets, while others may include a fixed azimuth clamp mount and a mechanical downtilt drive mechanism.

Turning to FIGS. 11-20, another embodiment 800 is illustrated. A linear mast 802 includes upper and lower mounts 803, 804 securing the top and bottom of the mast 802 to the main mount post 20. The lower pivot block 804 includes a cylindrical shaft 806 which is received into a race bearing 808 mounted within the lower pivot mount. The shaft 806 is formed as part of and end cap for the mast 802. The race bearing 808 may be a sealed bearing for weather resistance and may further be self-centering to provide tolerance for a misaligned mounting post 20 or misaligned mounts 803, 804. The upper pivot pin 810 is a keyed shaft as described above and is received directly into the keyed gear reduction assembly 812 (same as unit 710 above), which is now located at the top of the mast 802 and secured to the mounting pole 20 with a modified clamp that extends from the gear reduction assembly 812. The keyed shaft 810 is also formed as part of an upper end cap for the mast 802. In the illustrated embodiment, the clamping mount 803 is secured with elongated fasteners that extend through clamping blocks 814 into the body of the gear reduction unit 812. Other mounting configurations are contemplated where the gear reduction assembly 812 is received above or below another pivot mount identical to the lower pivot mount 806. The antenna 102 is mounted to the mast 802 and rotation of the mast 802 is driven and controlled in a similar manner as noted above with embodiment 700. As noted above, the gear reduction 812 may preferably comprise a 60 to 1 self-locking worm gear reduction with either reduced or zero backlash. The output drive 816 is the same keyed cylinder of the gear reduction unit 812 which is received at the top of the mast 802. The keyed shaft 810 extends directly into the keyed cylinder 816 from below. The MACU 171A is another AISG compatible ACU unit and is coupled to the input shaft 818 of the gear reduction unit 812 to drive rotation. It is noted here that the present MACU unit utilizes a servo motor configuration with a planetary gear reduction as opposed to a stepper motor configuration. The servo motor configuration with a high planetary gear reduction is advantageous because it better self-locks without the application of voltage. This was an inherent drawback to the use of a stepper motor configuration which allowed the drive shaft to rotate when power was not applied. The input shaft 818 is provided with an opening compatible with the drive pin of the MACU unit 171A. The MACU 171A includes male and female AISG bidirectional serial ports 820, 822 as previously described. The antenna 102A utilizes the same ACU units designated as 104A. All of the ACU 104A, MACU 171A and MTCU 192A motor controllers are serially connected as described above and capable of serial interconnected communication using the AISG protocol and appropriate AISG compatible cables (not shown for clarity).

Like the mast above, the mast 802 is adaptable in size (length as well as width and depth) for different size antennas 102 and can be universally adapted for connection to different antennas using different adapter connections. The mast 802 is further provided with longitudinal mounting channels 824 to universally receive a variety of different accessories at any location on any surface of the mast 802. This is particularly suitable for mounting cable stays and EMI shielding in appropriate locations along the mast 802.

A lower pivot bracket 826 is secured to the lower portion of the mast 802. The lower pivot bracket 826 is slidably received around the mast 802 and is slidably adjustable in location along the length of the mast 802 to accommodate different size antennas 102. The bracket 826 has a support arm 828 which extends forwardly and is pivotably mated with a mounting bracket 830 on the lower rear of the antenna 102A.

The dual guide linear actuator 704 (from above) is replaced by a linear actuated guide rod assembly 832 which is pivotably secured at one end to the mast 802 and at the other end to the upper antenna interface bracket 834. The linear actuator unit 832 may in some embodiments comprise an SLA55 Rod Actuator with a 300 mm stroke length (Anaheim Automation). The actuator 832 includes a main body portion 836 which houses a threaded rod 838. The terminal end of the rod 838 extends from the housing 836 and includes a rotatable head 840. The head 840 is pivotably secured to the mounting bracket 834 on the upper end of the antenna 102A. Rotation of the threaded rod 838 extends the rod 838 from the housing 836 to create elongation or extension of the unit 832 and resulting downtilt of the antenna 102A relative to the mast 802.

A fixed pivot block 842 is slidably secured to the upper end of the mast 802 and includes a pivot pin 844 which extends through the block 842 and through a base end of the actuator body 836. The MTCU 192A is mounted to the body 836 of the actuator 832 and through a right-angle drive coupling 846 drives the threaded drive rod 838. As noted above, the top of the antenna 102 is secured to the pivoting head 840 on the drive rod 838. The linear outward extension of the drive rod 838 pushes the top end of the antenna 102 outwardly to provide a controlled downtilt of the antenna 102 similar to the previous embodiments. Reverse motion draws the threaded rod 838 in and returns the antenna to its 0 degree upright position. The linear actuator sub-assembly 832 and block 842 are adjustable in location on the mast 802 for different size antennas and different mounting needs. The upper and lower mount bodies 803, 804 are still independently adjustable in location on the mounting pole 20.

In some embodiments, the entire downtilt mechanism may be eliminated to provide an azimuth only adjustment along with electrical downtilt. In this case, a second bracket 826 replaces the upper linear actuator assembly 832 to provide another fixed mounting point to a bracket 830 at the upper end of the antenna 102. Further in this case, the support arms 828 on the brackets can be shorter bringing the antenna 102 closer to the mast 802 and improving the center of gravity of the entire device.

FIGS. 21-33 illustrate a further embodiment 1000, where the upper mount, gear reduction, pivot and MACU system are integrated into an enclosed drive unit 1001.

A linear mast 1002 is rotatably captured between a lower mount 1003 and the integrated drive unit 1001 securing the top and bottom of the mast 1002 to the main mount post 20. The lower portion of the mast 1002 is provided with a pivot shaft (not shown—see pivot shaft 806 in earlier FIG. 20) which is received into a thrust bearing (not shown—see bearing 808 in earlier FIG. 20) mounted within the lower pivot mount 1003. The shaft is formed as part of and end cap for the mast 1002. The lower mount 1003 may include a lip seal (not shown) for protecting the bearing for weather resistance.

The upper mount may comprise a fully integrated support and rotational drive unit 1001 including a housing 1004 which is clamped to the main mount post 20. In the illustrated embodiment, the drive housing 1004 is secured with elongated fasteners that extend through a clamp 1008 into the drive housing 1004 to capture the post 20 therebetween.

Turning to FIGS. 25-29, contained within the drive housing 1004 is a main drive hub 1010 which is rotatably mounted on bearings 1012 between the housing 1004 and the mount body cover 1014. The main drive hub 1010 includes a shaped drive post 1016 which extends through one of the bearings and through an opening in the cover 1014 where it receives the upper end of the mast 1002. The upper portion of the mast is keyed to the shaped posted 1016 on the drive hub by its internal extruded shape geometry, or alternatively the hub may have a complementary shape which captures the external surface of the mast (see earlier FIG. 19).

The main drive hub 1010 includes a drive gear section 1018 which is mated with a corresponding worm gear 1024 rotatably mounted within a sliding carriage system 1050 which allows easier assembly. The worm gear drive ratio may be 50 to 1 or greater to provide a self-locking gear assembly with either reduced or zero backlash.

In the present integrated drive unit, the MACU 171A includes a servo drive motor 1052 with a planetary gear reduction between about 100-1 to 300-1. The servo motor 1052 configuration with a high planetary gear reduction is advantageous because it provides an effective brake on the worm gear 1024 further improving the self-locking aspect of the worm gear assembly without the application of voltage on the motor 1052.

The motor 1052 is secured within the carriage 1050 and coupled to a worm gear drive shaft 1054.

The motor 1052 is controlled by an AISG compatible controller 1056. End stop positions are sensed by a magnetic position sensor arrangement integrated with the drive hub 1010. Rotational position sensing between the end stops is provided by a multichannel encoder 1058 integrated with the motor and motor drive shaft.

In the end stop arrangement, a hall sensor 1060 contains an internal magnet and Hall effect sensor mounted in a twin tower configuration. An arcuate ferrous target vane 1062 of predetermined arc length is secured to the drive hub 1010. The target vane 1062 is sized for a particular arc length corresponding to the desired rotational drive extent of the antenna 102. As the drive hub 1010 rotates with rotation of the motor 1052 and worm 1024, the target vane 1062 passes between the tower gap in the sensor 1060, and when a respective end of the target vane 1062 passes the Hall sensor 1060, the magnetic field is interrupted, and switches the digital state of the sensor to signal end of travel extent. As noted above, rotational position between the end stops 1062A,B is measured by the motor multichannel encoder 1058 which counts pulses between the opposing end stops 1062A,B.

The MACU 171A includes male and female AISG bidirectional serial ports 1020, 1022 as previously described. The antenna 102 utilizes the same ACU units designated previously as 104. All of the ACU 104A, MACU 171A and MTCU 192A motor controllers are serially connected as described above and capable of serial interconnected communication using the AISG protocol and appropriate MSG compatible cables (not shown for clarity).

The antenna 102 is mounted to the mast 1002 and rotation of the mast 1002 is driven and controlled in a similar manner as noted above with earlier described embodiments.

Like the masts above, the mast 1002 is adaptable in size (length as well as width and depth) for different size antennas 102 and can be universally adapted for connection to different antennas using different adapter connections. The mast 1002 is further provided with longitudinal mounting channels to universally receive a variety of different accessories at any location on any surface of the mast 1002. This is particularly suitable for mounting cable stays, EMI shielding, RF shielding, etc. in appropriate locations along the mast 1002.

A lower pivot bracket 1026 is secured to the lower portion of the mast 1002. The lower pivot bracket 1026 is slidably received around the mast 1002 and is slidably adjustable in location along the length of the mast 1002 to accommodate different size antennas 102. The bracket 1026 has a support arm 1028 which extends forwardly and is pivotably mated with a mounting bracket 1030 on the lower rear of the antenna 102.

The downtilt linear actuator assembly 1032 (MTCU) is pivotably secured at one end to an arm bracket 1033 on the upper portion of the mast 1002 and at the other end to the upper antenna interface bracket 1034. The actuator 1032 includes a main body portion 1036 which houses a threaded drive rod 1038 which may have a thread pitch of 8-1 to 20-1. In the present embodiment, the thread pitch is 10-1. Similar to the worm gear self-locking arrangement, the higher thread pitch provides a stable self-locking actuator which will resist vibration and movement. The threaded drive rod 1038 is driven by a servo drive motor 1044 with a planetary gear reduction between 100-1 to 300-1. The servo motor configuration with a high planetary gear reduction is advantageous because it provides an effective brake on the threaded drive rod 1038 further improving the self-locking aspect of the assembly without the application of voltage on the motor 1044.

The threaded drive rod 1038 is rotatably coupled to a threaded drive nut 1046 (lead nut) which is part of a piston 1040. The terminal end of the piston 1040 extends from the housing 1036 and includes a pivot head which is pivotably secured to the mounting bracket 1034 on the upper end of the antenna 102. Rotation of the threaded rod 1038 extends the piston 1040 from the housing 1036 to create elongation or extension of the unit 1032 and resulting downtilt of the antenna 102 relative to the mast 1002.

The motor 1044 is secured on a motor mount within the interior extended profile of the housing 1036 and is coupled to the threaded rod 1038 by a suitable drive coupler.

The motor 1044 is controlled by an AISG compatible controller (MTCU) 1064. similar to the MACU, end stop position is sensed by a magnetic position sensor arrangement integrated with the housing 1036 and piston 1040. Position sensing is provided by a multichannel encoder 1066 integrated with the motor drive shaft.

In the end stop arrangement, a hall sensor 1068 is mounted to the housing 1036 and contains an internal magnet and Hall effect sensor mounted in a twin tower configuration. A ferrous target vane 1070 is linear and secured longitudinally along the piston body 1040. The target vane length is sized for a particular linear travel distance corresponding to the desired extension of the piston 1040 corresponding to a desired downtilt angle of the antenna 102. As the piston 1040 extends the target vane 1070 passes between the tower gap in the sensor 1068, and when the ends 1070A,B of the target vane 1070 pass the Hall sensor 1068, the magnetic field is interrupted, and switches the digital state of the sensor.

As noted above, the top of the antenna 102 is secured to the pivoting head on the piston rod 1040. The linear outward extension of the piston 1040 pushes the top end of the antenna 102 outwardly to provide a controlled downtilt of the antenna 102 similar to the previous embodiments. Reverse motion draws the piston 1040 in and returns the antenna to its 0 degree upright position. The linear actuator sub-assembly 1032 and block 1042 are adjustable in location for different size antennas and different mounting needs. The upper drive unit 1001 and lower mount 1003 are still independently adjustable in location on the mounting pole 20. In some embodiments, it may be advantageous to pin the drive unit 1001 and the lower mount 1003 to the pole to fix the vertical location and rotational orientation of the mounts to the post 20. In particular, proper rotational orientation of the drive unit and lower mount is critical to providing proper rotation of the mast 1002.

In some embodiments, a bellows 1074 may be captured between the terminal end of the housing 1036 and the piston head to create a sealed environment protecting the ferrous target vane 1070 from the elements.

In some embodiments, the entire downtilt mechanism may be eliminated to provide an azimuth only adjustment along with electrical downtilt. In this case, a second bracket replaces the upper linear actuator assembly to provide another fixed mounting point to a bracket at the upper end of the antenna 102. Further in this case, the support arms on the brackets can be shorter bringing the antenna 102 closer to the mast 1002 and improving the center of gravity of the entire device.

It can therefore be seen that the exemplary embodiments provide a remotely controllable antenna mount is particularly useful with a wireless telecommunication antenna to provide mechanical azimuth and/or tilt adjustment using AISG compatible motor control units and AISG control and monitoring systems to remotely adjust the physical orientation of the antenna.

While there is shown and described herein certain specific structures embodying various embodiments of the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims

What is claimed is:

1. An actuator assembly for remote positioning of a wireless telecommunication antenna comprising:

an elongated mast;

a bracket assembly configured to secure a telecommunication antenna to said mast;

a lower pivot mount comprising a housing, a bearing assembly rotatably receiving a lower end of said mast, and a clamp cooperating with the housing to secure the housing to a mounting post;

an upper rotational drive assembly comprising a housing, a drive hub rotatably mounted in the housing and extending through said housing to receive an upper end of said mast, a clamp cooperating with the housing to secure the housing to a mounting post, a drive gear coaxially associated with the drive hub within the housing, a worm gear configured to drive said drive gear, a reversible motor configured to drive said worm gear, an arcuate target vane mounted to said drive hub, said target vane having a predetermined arc length corresponding to a predetermined rotational drive extent of the antenna and a corresponding azimuth range of said antenna, said target vane having opposing ends defining rotational end of travel positions, a sensor positioned within the housing and adjacent the drive hub and configured to detect presence of the target vane when said drive hub is rotating between the rotation end of travel positions, a position encoder associated with the motor shaft and configured to detect rotations of the motor shaft when said drive hub is rotating between the rotation end of travel positions; and an AISG compatible azimuth controller associated with the motor, the sensor and the encoder for selectively driving rotation of the mast to predetermined azimuth positions within said predetermined rotational drive extent.

2. The actuator assembly of claim 1 wherein said sensor is a hall effect sensor and said target vane is a magnetic material.

3. The actuator assembly of claim 2 wherein said motor and said worm gear are mounted on a carriage removably secured within the housing.

4. The actuator assembly of claim 1 wherein said motor and said worm gear are mounted on a carriage removably secured within the housing.

5. The actuator assembly of claim 1 wherein said bracket assembly comprises a downtilt bracket assembly having a lower pivoting bracket arm and an upper extension arm bracket.

6. The actuator assembly of claim 5 wherein said upper extension arm bracket includes a downtilt drive assembly comprising:

a housing pivotably secured to said mast;

a piston arm mounted in the housing and having a distal end extending through said housing, said distal end being configured to pivotably secure to said antenna;

a drive nut at a proximal end of the piston arm;

a threaded drive rod rotatably mounted within said housing and engaged for rotation with the drive nut;

a reversible motor mounted within the housing and configured to reversibly drive said threaded drive rod and linearly actuate the engaged piston arm between a retracted position and an extended position;

a linear target vane mounted longitudinally to said piston arm, said target vane having a predetermined linear length corresponding to a predetermined linear extension of the piston arm and a corresponding angular downtilt range of said antenna, said target vane having opposing ends defining linear end of travel positions, a sensor positioned within the housing and adjacent the piston arm and configured to detect presence of the target vane when said piston arm is linearly actuated between the linear end of travel positions, a position encoder associated with the motor shaft and configured to detect rotations of the motor shaft when said piston arm is actuated between the linear end of travel positions; and an AISG compatible downtilt controller associated with the motor, the sensor and the encoder for selectively driving linear extension and retraction of the piston arm to predetermined angular downtilt positions within said predetermined linear drive extent.

7. The actuator assembly of claim 6 wherein said sensor is a hall effect sensor and said target vane is a magnetic material.

8. An actuator assembly for remote positioning of a wireless telecommunication antenna comprising:

a mast;

a lower pivoting bracket arm secured to the mast and configured to be pivotably secured to an antenna; and an upper downtilt drive assembly comprising:

a housing pivotably secured to said mast;

a piston arm mounted in the housing and having a distal end extending through said housing, said distal end being configured to pivotably secure to said antenna;

a drive nut at a proximal end of the piston arm;

a threaded drive rod rotatably mounted within said housing and engaged for rotation with the drive nut;

a reversible motor mounted within the housing and configured to reversibly drive said threaded drive rod and linearly actuate the engaged piston arm between a retracted position and an extended position;

a linear target vane mounted longitudinally to said piston arm, said target vane having a predetermined linear length corresponding to a predetermined linear extension of the piston arm and a corresponding angular downtilt range of said antenna, said target vane having opposing ends defining linear end of travel positions, a sensor positioned adjacent the piston arm and configured to detect presence of the target vane when said piston arm is linearly actuated between the linear end of travel positions, a position encoder associated with the motor shaft and configured to detect rotations of the motor shaft when said piston arm is actuated between the linear end of travel positions; and an AISG compatible downtilt controller associated with the motor, the sensor and the encoder for selectively driving linear extension and retraction of the piston arm to predetermined angular downtilt positions within said predetermined linear drive extent.

9. The actuator assembly of claim 8 wherein said sensor is a hall effect sensor and said target vane is a magnetic material.

* * * * *